US009238539B2

(12) United States Patent
Lynch

(10) Patent No.: US 9,238,539 B2
(45) Date of Patent: Jan. 19, 2016

(54) MODULAR HYDRATION SLEEVE AND METHODS THEREOF

(76) Inventor: Justin Morgan Lynch, Lehi, UT (US)

( * ) Notice: Subject to any disclaimer, the term of this patent is extended or adjusted under 35 U.S.C. 154(b) by 643 days.

(21) Appl. No.: 13/567,772

(22) Filed: Aug. 6, 2012

(65) Prior Publication Data

US 2013/0056372 A1 Mar. 7, 2013

Related U.S. Application Data

(60) Provisional application No. 61/530,081, filed on Sep. 1, 2011, provisional application No. 61/569,953, filed on Dec. 13, 2011.

(51) Int. Cl.

| | |
|---|---|
| ***A45F 3/16*** | (2006.01) |
| ***B65D 75/58*** | (2006.01) |
| ***A45F 5/00*** | (2006.01) |
| ***A45F 3/20*** | (2006.01) |

(52) U.S. Cl.

CPC ..... *B65D 75/5877* (2013.01); *A45F 3/20* (2013.01); *A45F 5/00* (2013.01); *A45F 2003/166* (2013.01); *A45F 2005/008* (2013.01); *A45F 2200/0583* (2013.01)

(58) Field of Classification Search

CPC ..... A45F 2003/008; A45F 2003/166

USPC ..... 224/148.1, 148.2, 148.4, 222

See application file for complete search history.

(56) References Cited

U.S. PATENT DOCUMENTS

| | | | | |
|---|---|---|---|---|
| 4,139,130 | A * | 2/1979 | Glusker et al. | 224/148.2 |
| 4,500,019 | A * | 2/1985 | Curley, Jr. | 224/222 |
| 4,988,097 | A * | 1/1991 | Smith et al. | 482/105 |
| 5,566,869 | A * | 10/1996 | Katz | 224/148.6 |
| 6,173,866 | B1 * | 1/2001 | Taylor et al. | 222/175 |
| 6,708,950 | B2 * | 3/2004 | Christensen et al. | 251/342 |
| 8,167,177 | B1 * | 5/2012 | Galgano | 222/175 |
| 8,444,021 | B1 * | 5/2013 | Ferreiro | 222/175 |
| 2006/0266776 | A1 * | 11/2006 | Plakke | 224/222 |
| 2007/0012733 | A1 * | 1/2007 | Horito et al. | 224/148.2 |
| 2007/0034634 | A1 * | 2/2007 | Brown | 220/703 |
| 2007/0095871 | A1 * | 5/2007 | Chen | 224/219 |
| 2008/0047990 | A1 * | 2/2008 | Morgan et al. | 224/222 |
| 2008/0169321 | A1 * | 7/2008 | Fidrych et al. | 224/148.2 |
| 2010/0032458 | A1 * | 2/2010 | Shitaye | 224/148.2 |

* cited by examiner

*Primary Examiner* — Adam Waggenspack

(74) *Attorney, Agent, or Firm* — Maschoff Brennan PLLC

(57) ABSTRACT

A method of hydrating a human can include: providing a bicep hydration sleeve; attaching the hydration sleeve to a bicep region of the human; lifting the hydration sleeve to the mouth of the human by moving the bicep toward the chin; inserting the mouthpiece of the hydration sleeve into the mouth; and drinking from the hydration sleeve, wherein the lifting, inserting, and drinking are performed without handling the hydration sleeve with either hand of the human.

19 Claims, 16 Drawing Sheets

MODULAR HYDRATION SLEEVE AND METHODS THEREOF

CROSS-REFERENCE

This patent application claims benefit of U.S. provisional application 61/530,081, filed Sep. 1, 2011, and U.S. provisional application 61/569,953, filed Dec. 13, 2011, which provisional applications are incorporated herein by specific reference in their entirety.

BACKGROUND

Dehydration or lack of adequate fluids can significantly impact the ability of a human to function, especially during athletic activities. While many devices are available to provide fluids to persons engaged in athletic activities, there are still many deficiencies of the available devices to adequately provide fluids without compromising athletic performance. Therefore, there still remains a need for improved hydration devices that are suitable for use while actively engaging in athletic activities without substantially compromising athletic performance.

SUMMARY

In one embodiment, a bicep hydration sleeve can include: a flexible fluid bladder having a bladder body defining an internal volume of less than or about 12 oz and having an opening therethrough; a mouthpiece rotatably coupled with the opening of the fluid bladder so as to be in fluid communication with the internal volume; and a flexible hydration sleeve body having a housing and one or more straps, the housing having an internal chamber dimensioned to retain the flexible fluid bladder with a chamber opening dimensioned to receive the flexible fluid bladder therethrough and having a mouthpiece aperture dimensioned to receive the mouthpiece therethrough when the flexible fluid bladder having the mouthpiece is located in the internal chamber, the one or more straps dimensioned such that the hydration sleeve body fits around a bicep region of a human, the one or more straps having at least a first strap with a first fastener member of a fastening system with a second fastener member of the fastening system being on the housing or another strap, the second fastener member of the fastening system being capable of receiving the first strap with the first fastener member therethrough and the first fastener member being configured to removably coupled with the first strap to secure the bicep hydration sleeve to the bicep. The bicep hydration sleeve is adapted to fit around the bicep region of the arm, which of course includes fitting around the circumference of that part of the arm so as to be around the bicep and tricep. The bicep region is considered to include the bicep and tricep and the entire arm portion between the shoulder to the elbow or from the arm pit to the elbow crease.

In one embodiment, the flexible fluid bladder can include: the opening being on a circumferential center axis of the bladder body between a center point and a perimeter edge; the bladder opening having an annular member configured to rotatably couple with the mouthpiece, the annular member being more rigid than the bladder body; the flexible fluid bladder having one or more expansion wings, each expansion wing having a first gusset and opposite second gusset; and an elongate resealable opening extending from about a gusset of one expansion wing to about a gusset of an opposite expansion wing.

In one embodiment, the mouthpiece can include: a shell defining an internal conduit and having a first portion at angle from a second portion, the angle from about 110 degrees to about 160 degrees, the first portion being configured to rotatably couple with the annular member and the second portion being configured as a bite valve; the annular member located at a bottom opening of the first portion; and a bite valve stem located in the internal conduit at the second portion.

In one embodiment, the hydration sleeve body can include: a base sheet member that forms a wall of the housing and the one or more straps; a top sheet member directly or indirectly coupled to the base sheet member so as to define the housing and internal chamber, the top sheet having the mouthpiece aperture; and the chamber opening being positioned between the base sheet member and top sheet member, the chamber opening having a closable mechanism.

In one embodiment, the housing can include; a pocket defined by the top sheet and an intermediate pocket sheet that is located between the top sheet and base sheet so that the pocket is adjacent to the top sheet and the internal chamber is defined by and/or adjacent to the base sheet, the pocket having a pocket opening; and a pocket fastener system at the pocket opening having a first pocket fastener member that fastens to a second pocket fastener member.

In one embodiment, the hydration sleeve body can include: the first strap being elongate and having a plurality of vent apertures; a second strap being shorter than the first strap, the second strap having the second fastener member; the first fastener member including VELCRO (e.g., hook and loop fastener); the second fastener member including a D-ring.

In one embodiment, a kit can include: the flexible fluid bladder, mouthpiece, and flexible hydration sleeve described herein as separate components. Also, the kit can include one or more of: a refill bottle having a nozzle adapted to be received through the opening of the fluid bladder; two or more reusable fluid bladders; two or more mouthpieces; and/or a plurality of disposable fluid bladders with at least one mouthpiece configured to puncture and fluidly couple with the disposable fluid bladders. The kit can also include a drying rack, where the drying rack is configured to hold the bladder for drying, such as by having one or more elongate members that can fit within the bladder opening or fit within the resealable opening so that the bladder has an opening pointing downward.

In one embodiment a method of hydrating a human can include: providing the hydration sleeve as described herein; attaching the hydration sleeve to a bicep region of the human; lifting the hydration sleeve to the mouth of the human by moving the bicep toward the chin; inserting the mouthpiece of the hydration sleeve into the mouth; and drinking from the hydration sleeve, wherein the lifting, inserting, and drinking are performed without handling the hydration sleeve with either hand of the human.

In one embodiment, the method can include: bending and/or raising the elbow of the arm having the hydration sleeve thereon so that the mouthpiece reaches the mouth of the human, wherein the mouth piece can extend less than 3 inches from the sleeve body (or less than 2.5 inches, or less than 2 inches, or less than 1.5 inches, or about or less than 1 inch); and operating the mouthpiece with the human's mouth so as to obtain a fluid from the fluid bladder. The top of the sleeve can be placed at or adjacent to chin and/or cheek during drinking.

In one embodiment, the method can include: passing the first strap through the second fastener member and fastening the first fastener member to the first strap, wherein the first fastener member can be on the same side of the strap that it attaches to; attaching the hydration sleeve to the bicep region such that the mouthpiece is more medial than lateral the mouthpiece is pointing medial; and rotating the mouthpiece to be angled toward the mouth of the human. The sleeve can be coupled to the bicep so that it does not slip during exercise or when the bicep region is held vertical. The skin-facing side of the sleeve can be non-slip or have rubber or neoprene that does not slip on skin.

In one embodiment, the method can include a sleeve preparatory protocol that includes: filling the bladder with water or electrolyte solution; inserting the bladder into the internal chamber of the housing; inserting the mouthpiece through the mouthpiece aperture; and closing the chamber opening.

In one embodiment, the method can include a cleaning protocol including: opening the bladder by unsealing a resealable elongate opening; inserting a cleaning solution into the bladder; optionally inserting a cleaning instrument into the bladder, cleaning the bladder with the cleaning solution and/or cleaning instrument; washing the cleaning solution from the bladder; and closing the bladder by resealing the resealable elongate opening. Optionally, the cleaning protocol can include using the drying rack to dry the bladder before closing or resealing the bladder. The drying rack can be used as described herein.

In one embodiment, the method can include performing an exercise routine while: lifting the elbow of the arm having the hydration sleeve towards the human's mouth such that the elbow crease is touching or adjacent to the chin and/or cheek; and/or holding the raised elbow so that the arm or bicep region is substantially parallel with ground or at an angle up to about 25, 30, 40, or 45 degrees with respect to the ground.

In one embodiment, the method can include performing an exercise routine while: placing the hand of the arm having the hydration sleeve to hold onto the opposite shoulder to maintain balance while drinking; or placing the hand of the arm having the hydration sleeve on an opposite side of the neck from the hydration sleeve to maintain balance while drinking.

In one embodiment, the method can include performing an exercise routine while: drinking with the neck of the human held straight and not bent or turned.

In one embodiment, the method can include performing an exercise routine while: moving the hydration sleeve on the bicep towards the human's mouth by movement of the arm having the bicep; moving the human's mouth downward towards the hydration sleeve; placing the mouthpiece into the human's mouth; biting the mouthpiece; and sucking fluid from the bladder without introducing a void space air into the bladder.

In one embodiment, the method can include exercising without sloshing water in the bladder by: removing gas from inside the bladder; and drinking from the bladder without introducing a void space or air therein.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1A:
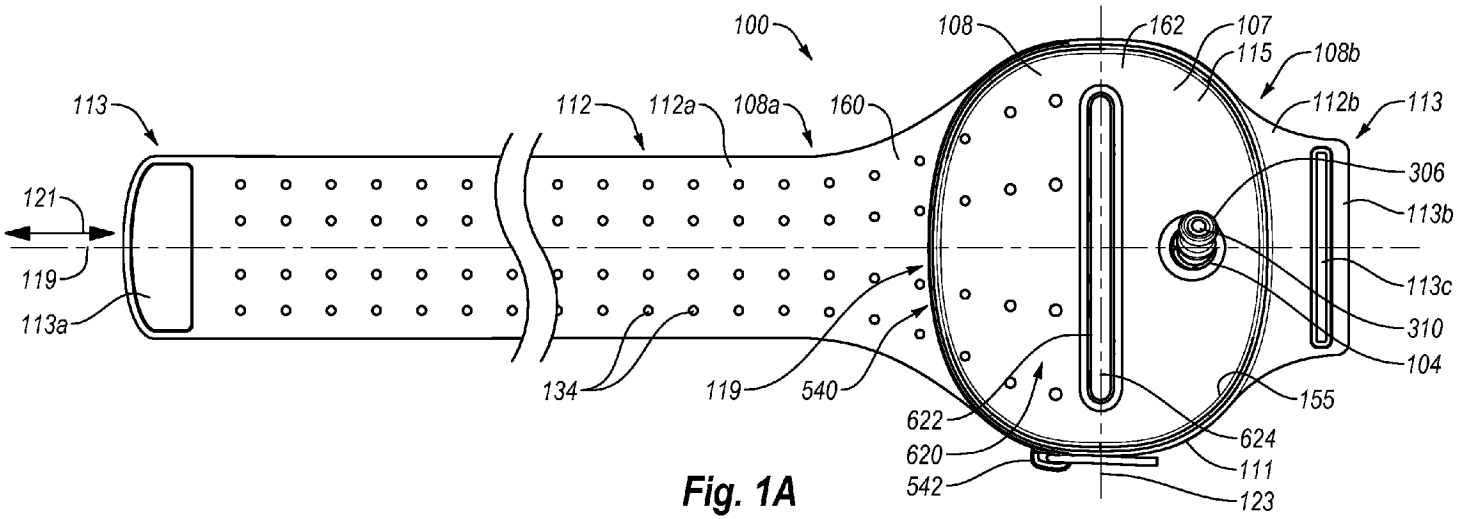
FIGS. 1A-1F illustrate different views of an embodiment of a bicep hydration sleeve.
Figure 1B:
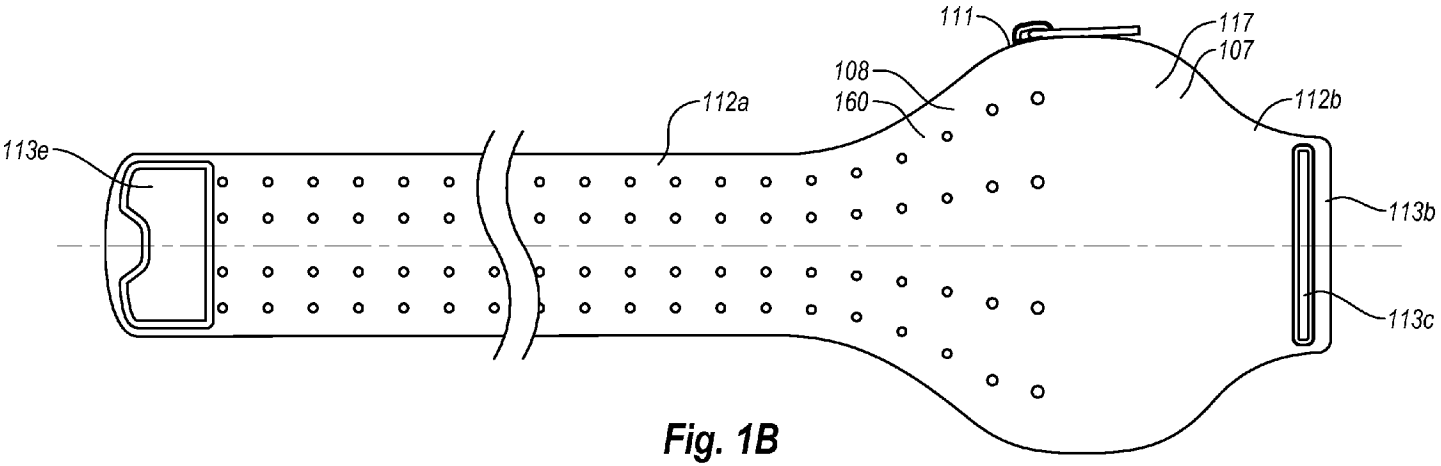
Figure 1C:
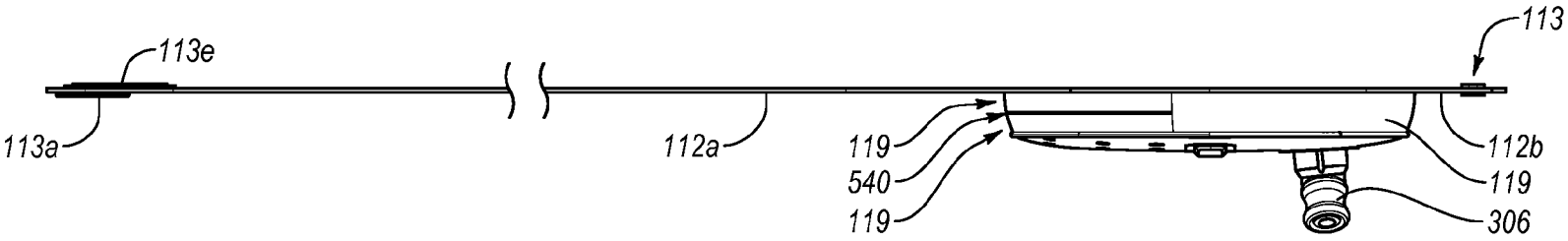
Figure 1D:
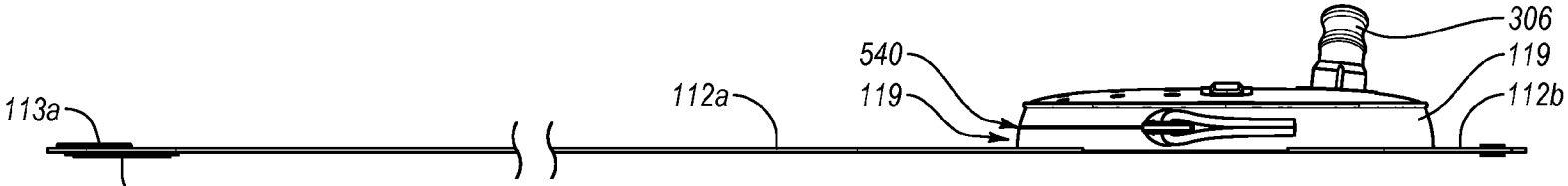
Figure 1F:
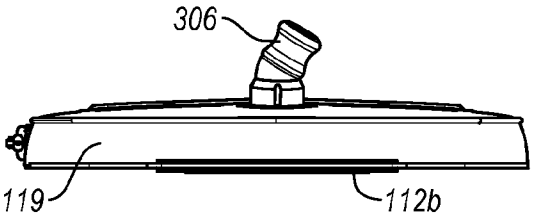
Figure 1E:
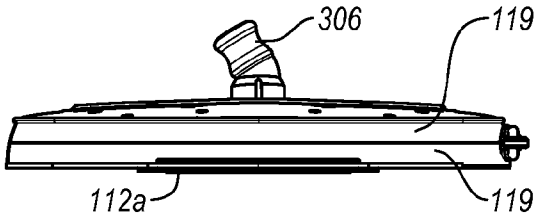

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Generally, the present invention relates to a hydration sleeve that is configured to be worn on the upper arm or bicep region between the elbow and shoulder. The bicep region is a unique anatomical area for attachment of a hydration device compared to common backpack-style, fannypack-style, or other wearable hydration devices. Also, the hydration sleeve of the present invention is unique in that it does not need use of hands in order to consume the liquid contained therein when worn. The bicep hydration sleeve is adapted to fit around the bicep region of the arm, which of course includes fitting around the circumference of that part of the arm so as to be around the bicep and tricep. The bicep region is considered to include the bicep and tricep and the entire arm portion between the shoulder to the elbow or from the arm pit to the elbow crease. The bicep hydration sleeve thereby may have a body that fits over the bicep and/or tricep area on the outside or lateral portion of the bicep region or upper arm between the shoulder and elbow. That is, the hydration sleeve can be moved to the user's mouth so that the liquid can be consumed without use of the user's hands. This can be accomplished by wearing the hydration sleeve on the bicep region with the mouthpiece properly oriented toward the mouth, and then raising the bicep to the user's mouth. The mouthpiece is configured as a bite valve so that the liquid can be consumed by biting and sucking on the mouthpiece when the bicep is as close as possible to the user's mouth. For example, during an exercise routine with the user wearing the hydration sleeve on the bicep region, the user can move the mouthpiece of the hydration sleeve toward and into their mouth and then bit and/or suck on the mouthpiece to draw liquid therefrom. The method of liquid consumption can be performed without use of the user's hands, which can be beneficial for a number of exercise routines. While the hydration sleeve is indeed portable and can be used in a number of ways, configuration as a bicep-wearable hydration sleeve can be advantageous.

In one embodiment, the present invention includes a hydration sleeve that is configured to be worn on the bicep region of a user. That is, the dimensions of the hydration device are configured for wearing as a bicep-wearable hydration sleeve. As such, the dimensions may be too large or inadequate (e.g., not tapered) for use on the forearm. The worn sleeve can form a lumen that is substantially cylindrical and match the anatomy of a bicep region. The bicep-wearable hydration sleeve has sufficient friction or sleeve compression against the bicep to prevent slippage down toward the elbow of the user when the bicep region is held vertical.

The cylindrical shape can be insufficient for forearm use as the taper of the forearm allows the sleeve to slide and fall down. However, in one embodiment, the hydration sleeve can be configured to be forearm-specific with a tapered lumen when worn.

Figure 2B:
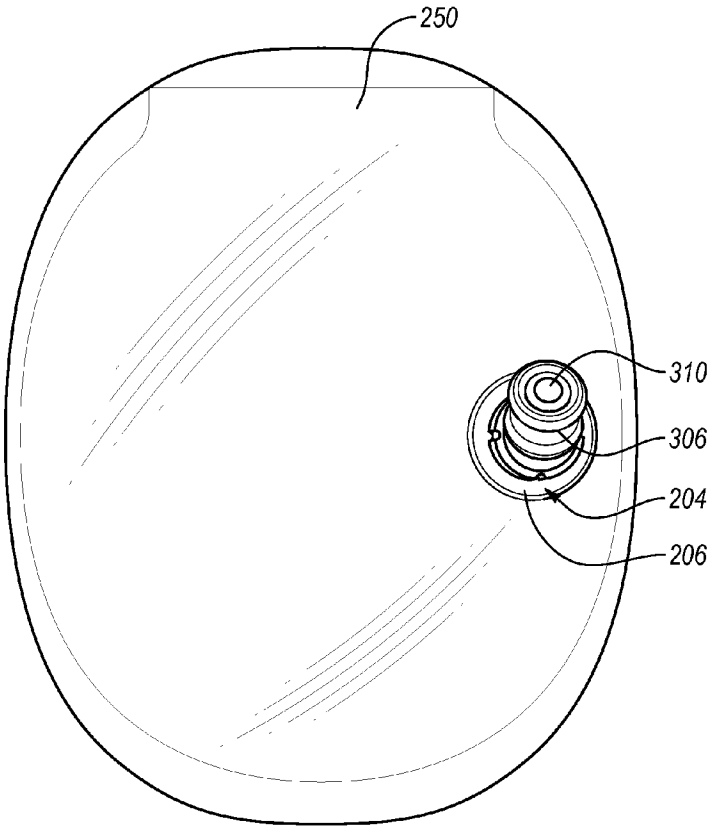
FIGS. 2A-2D illustrate different views of an embodiment of a flexible hydration bladder.
Figure 2A:
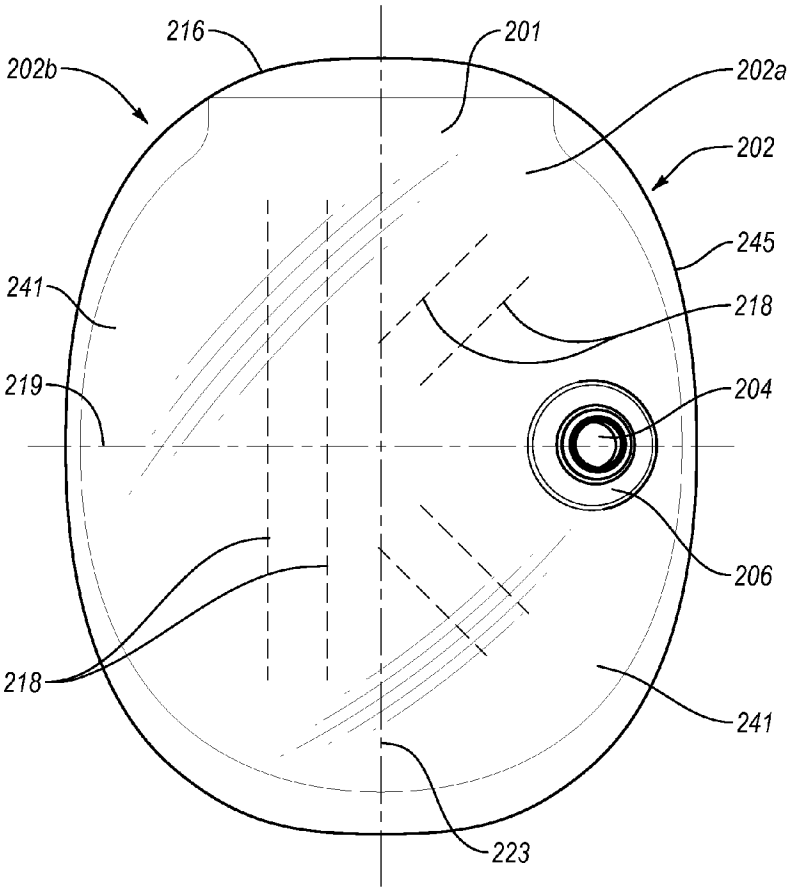
Figure 3A:
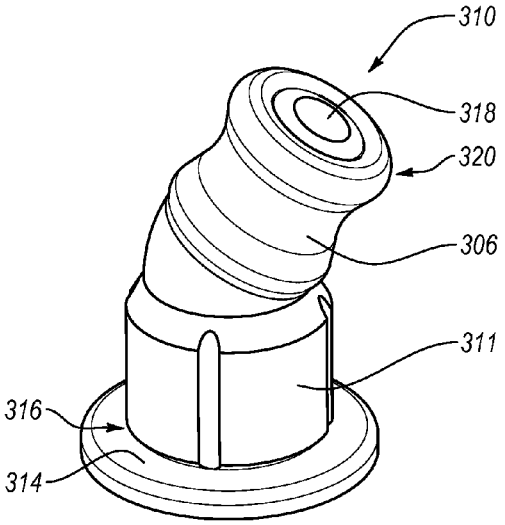
FIGS. 3A-3D illustrate different views and different embodiments of a mouthpiece.
Figure 3B:
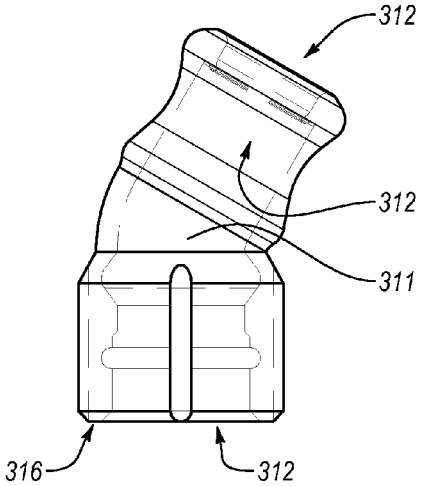
Figure 3C:
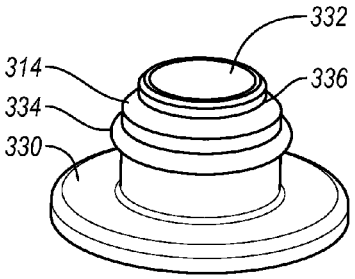
Figure 4B:
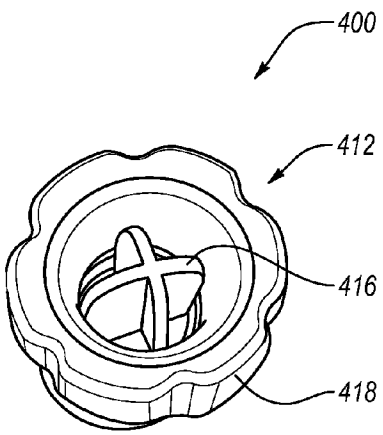
FIG. 4B illustrates an embodiment of a reusable mouthpiece for use with the disposable fluid bladder of FIG. 4A.
Figure 4A:
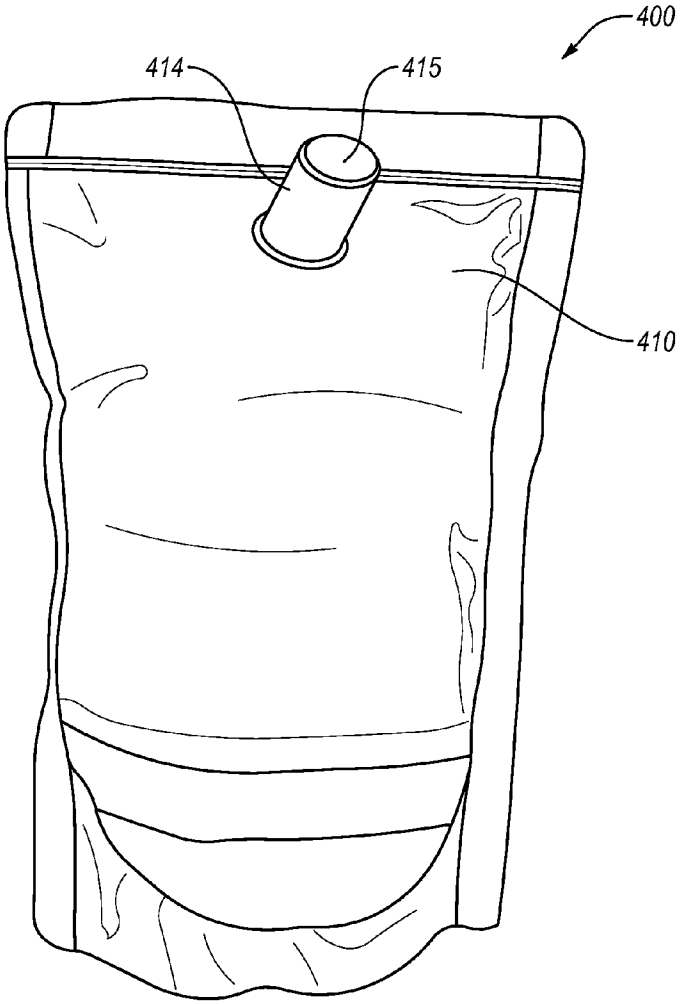
FIG. 4A illustrates an embodiment of a disposable fluid bladder.
Figure 5A:
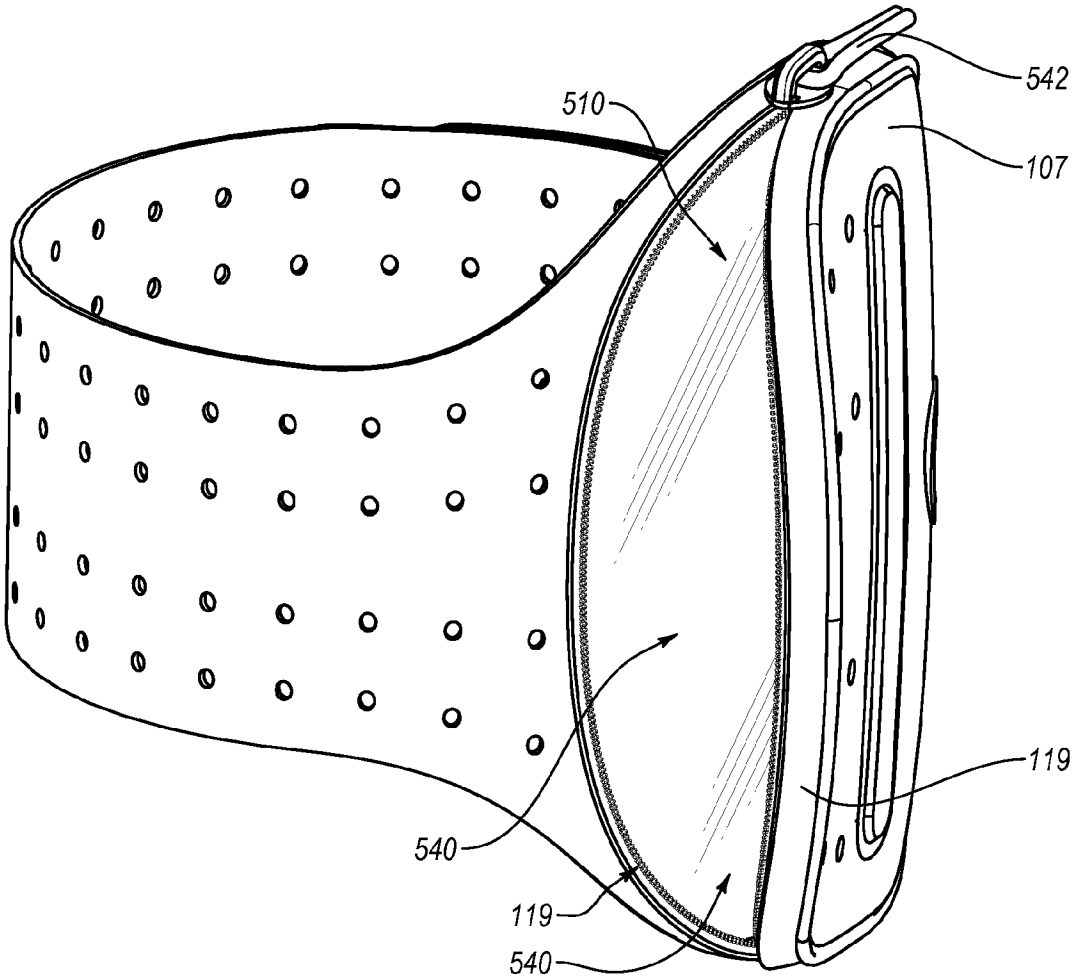
FIGS. 5A-5B illustrate an embodiment of an internal chamber of a hydration sleeve adapted to receive a fluid bladder.
Figure 5B:
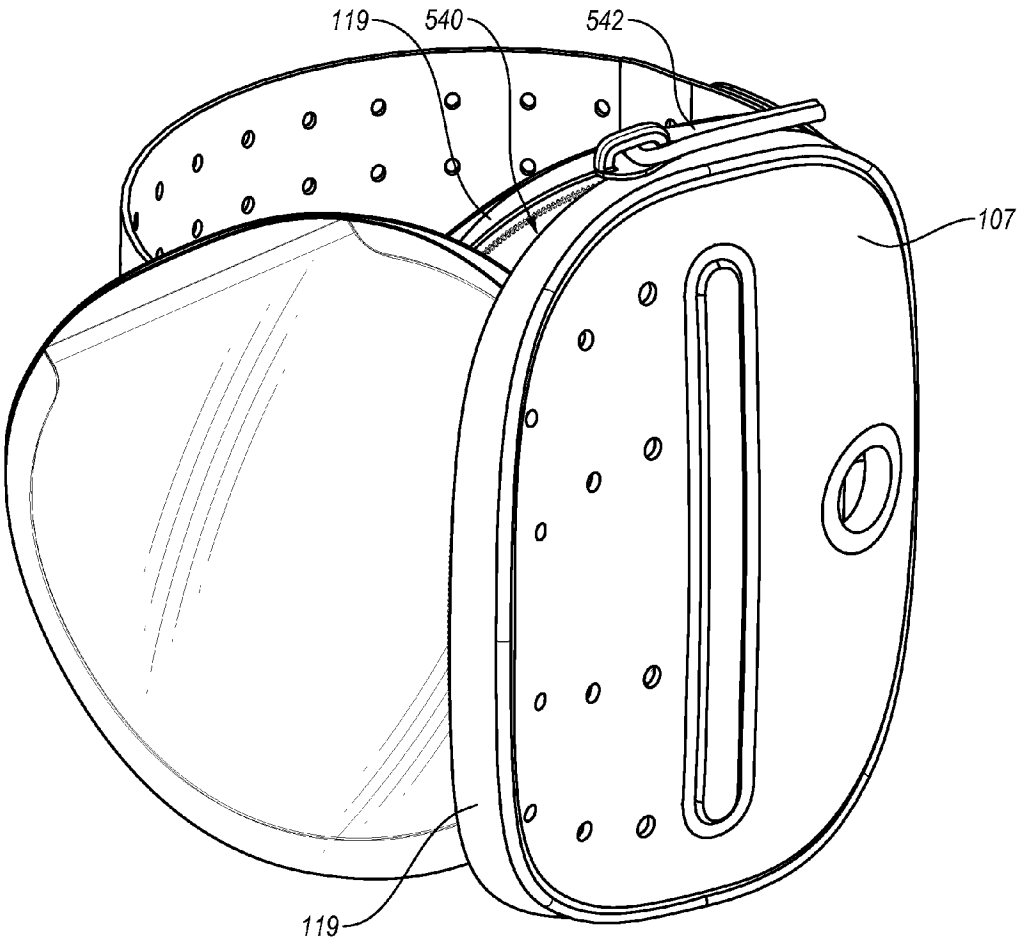
Figure 6A:
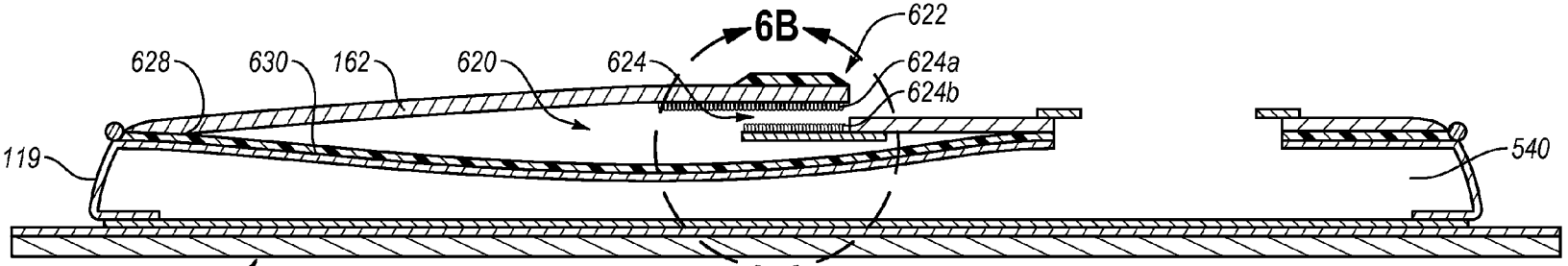
FIG. 6A-6B illustrate an embodiment of a pocket of a hydration sleeve.
Figure 6B:
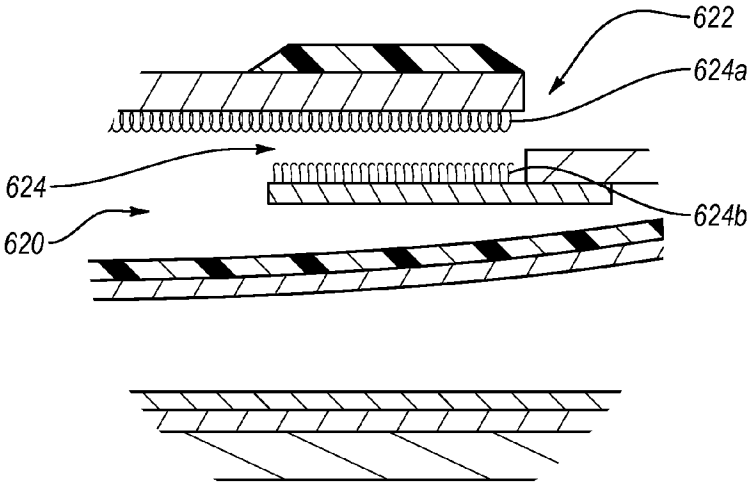
Figure 7B:
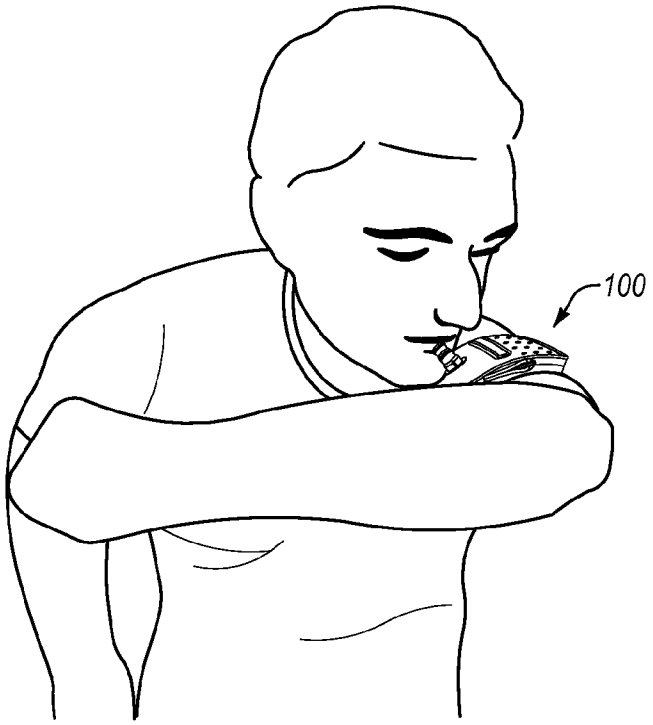
FIGS. 7A-7B illustrate an embodiment of a hydration method.
Figure 7A:
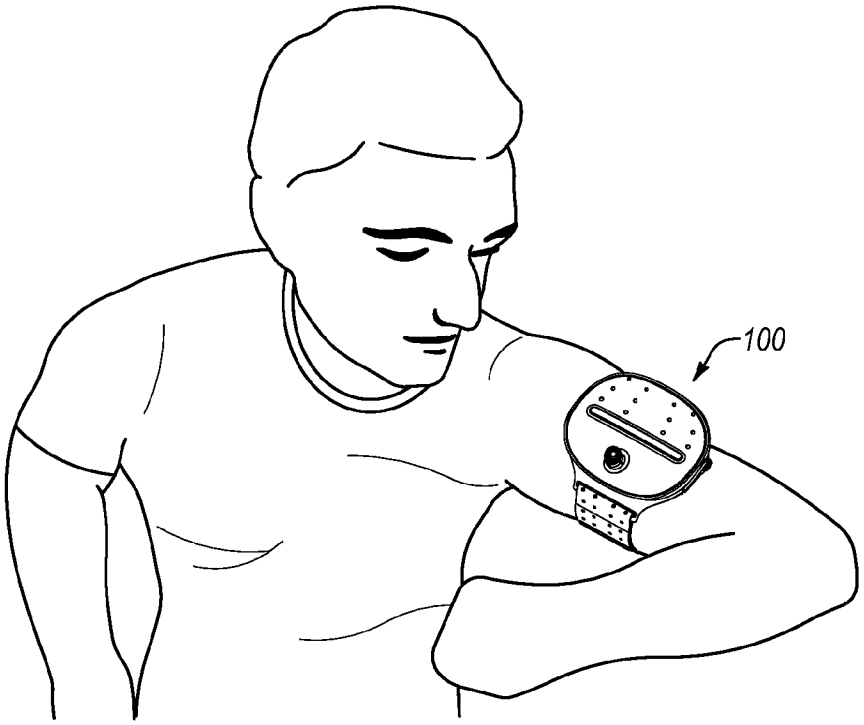

FIGS. 1A-1F illustrate an embodiment of a bicep-wearable hydration sleeve 100. FIGS. 2A-2B illustrate an embodiment of a fluid container 202 having a removable mouthpiece 306. FIGS. 3A-3D illustrate an embodiment of the mouthpiece 306 and components thereof. FIGS. 4A-4B illustrate an embodiment of a disposable fluid container 400 and reusable mouthpiece 418 of a kit. FIGS. 5A-5B illustrate an embodiment of the hydration sleeve 100 and internal chamber 510 that holds the fluid container 202 therein. FIGS. 6A-6B illustrate an embodiment a cutaway side view of the body 108 that shows the internal chamber 510 and pocket 620. FIGS. 7A-7B illustrate an embodiment of a method of hydrating with the hydration sleeve 100. FIGS. 8-18 illustrate alternative embodiments of the hydration sleeve 100.

FIGS. 1A-1F illustrate an embodiment of a bicep hydration sleeve 100. The hydration sleeve is shown to include a flexible fluid bladder 202 disposed therein (FIGS. 2A-2D) having a bladder body defining an internal volume of less than or about 12oz and having an opening 204 therethrough. A mouthpiece 306 is rotatably coupled with the opening 204 of the fluid bladder 202 so as to be in fluid communication with the internal volume. A flexible hydration sleeve body 108 has a housing 107 and one or more straps 112. The housing 107 has an internal chamber 510 (FIG. 5A) dimensioned to retain the flexible fluid bladder 202 with a chamber opening 540 dimensioned to receive the flexible fluid bladder therethrough and having a mouthpiece aperture 104 dimensioned to receive the mouthpiece 306 coupled therethrough when the flexible fluid bladder 202 having the mouthpiece 306 is located in the internal chamber 510. The one or more straps 112 can be dimensioned such that the hydration sleeve body 108 fits around a bicep region of a human (FIGS. 7A-7B), and may be bicep-specific and not capable of securely fitting around another anatomy region, such as the forearm, thigh, calf, waist, chest, neck, or the like. The one or more straps 112 have at least a first strap 112*a* with a first fastener member 113*a* of a fastening system 113 with a second fastener member 113*b* of the fastening system being on the housing 107 or another strap 112*b*. The second fastener member 113*b* of the fastening system 113 being capable of receiving the first strap 112*a* with the first fastener member 113*a* therethrough and the first fastener member 113*a* being configured to removably coupled with the first strap 112*a*.

The hydration sleeve body 108 can include a base sheet member 160 that forms a wall of the housing 107 and the one or more straps 112. The body 108 can include a top sheet member 162 directly or indirectly coupled to the base sheet member 160 so as to define the housing 107 and internal chamber 510. The top sheet member 162 can have the mouthpiece aperture 104. The chamber opening 540 can be positioned between the base sheet member 160 and top sheet member 162. The chamber opening 540 can have a closable mechanism 542, such as VELCRO (e.g., hook and loop fastener), buttons, or a zipper.

The housing 107 can include a pocket 620 (FIGS. 6A-6B) defined by the top sheet member 162 and an intermediate pocket sheet 630 that is located between the top sheet member 162 and base sheet member 160 so that the pocket 620 is adjacent to the top sheet member 162 and the internal chamber 540 is adjacent to the base sheet member 160. The pocket 620 having a pocket opening 622. A pocket fastener system 624 at the pocket opening 622 having a first pocket fastener member 624*a* that fastens to a second pocket fastener member 624*b*.

The hydration sleeve body 108 can include the first strap 112*a* being elongate and having a plurality of vent apertures 134. A second strap 112*b* can be shorter than the first strap 112*a*. The second strap 112*b* can have the second fastener member 113*a*. The first fastener member 113*a* can including VELCRO (e.g., hook and loop fastener), and the second fastener member 113*b* can include a D-ring.

The hydration sleeve 100 is shown with and without the removable fluid container 202 that includes the removable mouthpiece 206. As shown, the hydration sleeve 100 includes a body 108 that contains the fluid container 202, where the body 108 includes an mouthpiece aperture 104 that receives the mouthpiece 306 therethrough. The mouthpiece 306 can be removably coupled with the mouthpiece aperture 104 of body 108. The mouthpiece 306 can include having a valve member 310 (FIGS. 3A-3D). Accordingly, the body 108 of the hydration sleeve 100 is dimensioned and has an internal chamber 510 (FIGS. 5A-5B) so as to receive the fluid container 202 therein such that with the mouthpiece 306 is exposed through the opening 104 in the body 108.

Generally, the hydration sleeve 100 can include one or more straps 112 that are coupled or integrated with the body 108, where each strap 112 or combination of straps 112*a*, 112*b* is dimensioned to fit around the bicep region on the arm of a human user and not around another region, such as being too long and/or cylindrical when worn for the forearm. The hydration sleeve 100 can include a fastener system 113 associated with the body 108 and/or straps 112 such that engagement of the fastener system 113 permits the hydration sleeve 100 to be worn on the bicep region of the arm of the human user, and disengagement of the fastener system 113 permits the hydration sleeve 100 to be removed from the bicep region of the arm of the subject. For example one side 108*a* of the body 108 can include a first strap 112*a* (e.g., long strap) and the other side 108*b* of the body 108 can include a second strap 112*b* (e.g., short strap) such that the first and second straps 112*a*,112*b* are sufficient to circumnavigate about the bicep region. In one aspect, the combination of straps 112*a*,112*b* can include the fastener system 113. In another aspect, an embodiment that has only one strap can include one fastener member 113*b* on the body and another fastener member 113*a* on the strap 112*a*, such that the fastener members 113*a*,113*b* cooperate to fasten the hydration sleeve 100 on the bicep region.

The fastener system 113 can include the first fastener member 113*a* being a VELCRO (e.g., hook and loop fastener) member and the second fastener member 113*b* being a "D" ring having an aperture 113*c* that receives a the first strap 112*a* therethrough such that the first fastener member 113*a* is received therethrough, and where the first fastener member 113*a* can then attach back onto the first strap 112*a*, such as through VELCRO (e.g., hook and loop fastener) or other fastening feature. The fastener system 113 can also have a release tab (not shown) that facilitate release of the first fastener member 113*b* from the first strap 112*a* when pulled. A grip tab 113*e* can also be included on the first strap 112*a* opposite of the first fastener member 113*a*, where the grip tab 113*e* facilitates engagement and disengagement of the fastener system 113. In one aspect, the fastener system 113 can include a D-ring 113*b* and a cooperative strap 112*a* of the one or more straps 112*a*,112*b*, the strap 112*a* having VELCRO (e.g., hook and loop fastener), with the hooks and hoops being on the same side of the strap 112*a*. In one aspect, the fastener system 113 can includes a D-ring 113*b* and a cooperative strap 112*a* of the one or more straps 112*a*,112*b*, the strap 112*a* having a securing system that can secure the strap 112*a* to itself, where the securing system can include snaps, buttons, or other fastener members. In one aspect, the fastener system 113 can include components that are integrated with the housing 107 or fluid container 202. In one aspect, the fastener system 113 can include one fastener member 113*a* on one strap 112*a* and a second fastener member 113*b* on a second strap 112*b*, the first and second fastener members being configured to cooperate in order to fasten together. In one aspect, the fastener system 113 can include one fastener member 113*a* on one strap 112*a* and a second fastener member 113*b* on the housing 107 or container 202.

As shown, the hydration sleeve 100 can be flexibly adapted to conform to the bicep region of the user. As such, the hydration sleeve 100 can include the fluid container 202 shaped or otherwise flexibly configured to conform with the bicep region of either arm of the human user so that the mouthpiece aperture 104 of the body 108 allows the mouthpiece 306 to be pointed toward the user's mouth.

In one embodiment, the hydration sleeve 100 can include a flexible body 108 having a flexible housing 107 for the internal chamber 510 that contains the fluid container 202. The flexible body 108 can be dimensioned and shaped to fit on a bicep region of an arm of a human, and the flexible housing 107 can define the internal chamber 510 and a chamber opening 540. The chamber 510 can have insulation to help keep the liquid in the fluid bladder 202 cool. The internal chamber 510 and chamber opening 540 can be dimensioned so as facilitate the fluid bladder 202, either empty or full, being removably received through the chamber opening 540 and into the internal chamber 510 and withdrawn therefrom as shown in FIG. 5A-5B. FIGS. 5A-5B also show that the opening 540 can include a closure member 542, which can be a zipper.

The housing 107 can define the mouthpiece aperture 104 dimensioned to removably receive the mouthpiece 306 such that the mouthpiece 306 is exposed from the housing 107 by extending through the mouthpiece aperture 104. The mouthpiece 306 can be coupled with the bladder opening 204 of the fluid bladder 202 when located outside of or within the internal chamber 510 by being inserted through the mouthpiece aperture 104 and coupled with the bladder opening 204.

The hydration sleeve 100 can include the housing 107 prepared from one or more sheet members 160, 162. The housing 107 can be formed from a front wall 115 that is coupled to a back wall 117 with a perimeter 111 via a perimeter coupling 155. Also, the housing 107 can be formed from a front wall 115 coupled to a back wall 117 with a perimeter coupling 155, and where one of the front wall 115 or back wall 117 also forms the one or more straps 112. Additionally, the housing 107 can be formed from a front wall 115 coupled to a back wall 117 with a perimeter coupling 155, and where one of the front wall 115 or back wall 117 also forms the long strap 112*a* and the short strap 112*b*. The perimeter coupling 155 which can be a weld, stitching, seam, zipper, stamped coupling, or other fastener that can couple two materials together. In some aspects, the front wall 115 and back wall are fabrics, such as neoprene, and the coupling 155 can be a stitching or welding. The hydration sleeve 100 and the body 108 and/or housing 107 and/or strap 112 components thereof can be prepared from any material that is suitable for use as described herein, however, it has been found that it can be advantageous for these components to be flexible. These components can advantageously be prepared from fabrics, rubber, synthetic rubber such as neoprene, polymeric material, such as nylon or any other suitable or similar material.

The straps 112 can be attached to the body 108 of the hydration sleeve 100 by various mechanisms, which include the straps 112 being integrated with one or more members of the body 108 or coupled thereto. When coupled, the type of coupling can be depending on the material of the body components, where stitching, welding, and adhesive can be examples. In one aspect, one or more walls of the body 108 and/or housing 107 can be integrated to include the one or more straps 112. In one example, the body 108 or housing 107 and one or more straps 112 can be integrated with the housing 107 formed from a back wall 117 and a front wall 115 coupled together. Optionally, one or more side walls 119 can be located between and coupled with the front wall 115 and back wall 117. In another example, the housing 107 and one or more straps 112 are integrated by the back wall 117 forming a back wall of the internal chamber 510 and forming the straps 112 with the front wall 115 forming a front wall of the internal chamber 510 by being coupled to the back wall 117. The front wall 115 can be coupled to the back wall 117 through one or more side walls 119. The coupling of these body components can be through welding, sowing stitching, seams, zipper, stamp, or other fastening configuration depending on the material.

In one embodiment, the one or more straps 112 are flexibly resilient so that they have some stretch and elastic property. As such, the straps 112 can be rubber or elastomeric or flexibly resilient fabric. The strap material can include fabrics, rubber, synthetic rubber such as neoprene, polymeric material, such as nylon or any other suitable or similar material. Also, the one or more straps 112 can include a padding member on a skin surface, which padding can be sticky or non-slip to the skin so that the hydration sleeve 110 does not slide with the bicep region is vertical and the fluid container is full of fluid. Neoprene or other rubber as well as hydrophobic polymeric materials can be used to provide the non-slip function on the skin. In one aspect, the one or more straps 112 include VELCRO (e.g., hook and loop fastener), which can include the protrusions (e.g., hooks) and receiving pad (e.g., loops). The front surface of the long strap 112*a* can include the receiving pad having loops, and the fastener member 113*a* can be the hooks.

Figure 8:
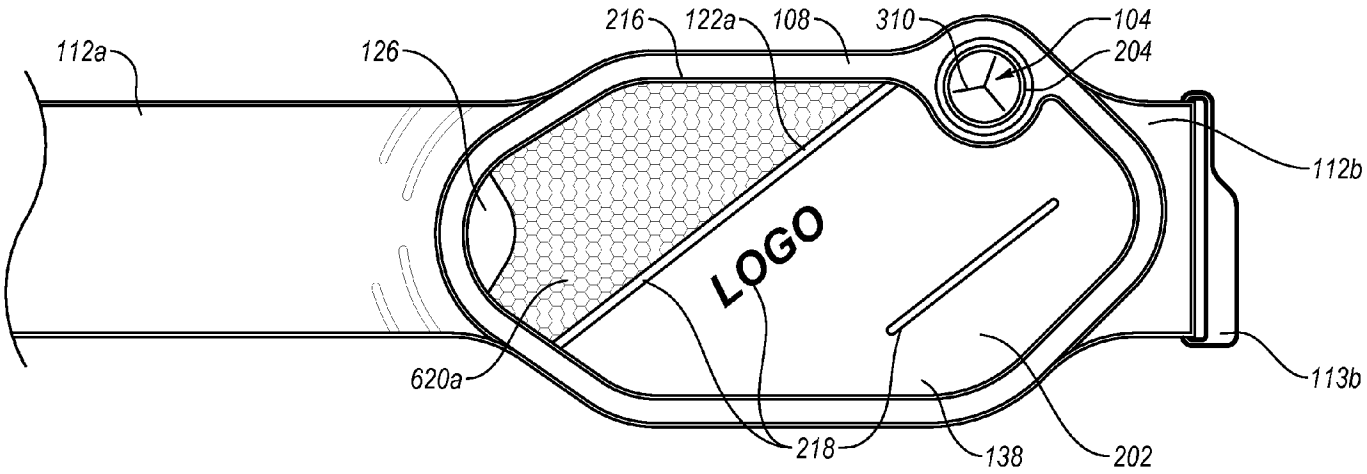
FIG. 8 illustrates an embodiment of a bicep hydration sleeve.
Figure 9:
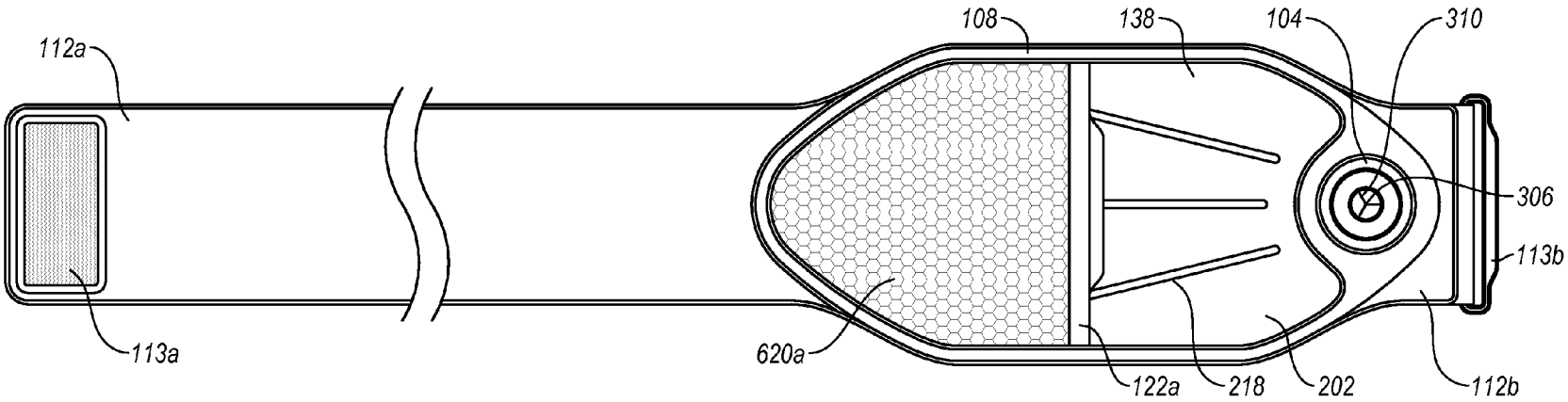
FIG. 9 illustrates an embodiment of a bicep hydration sleeve.
Figure 10:
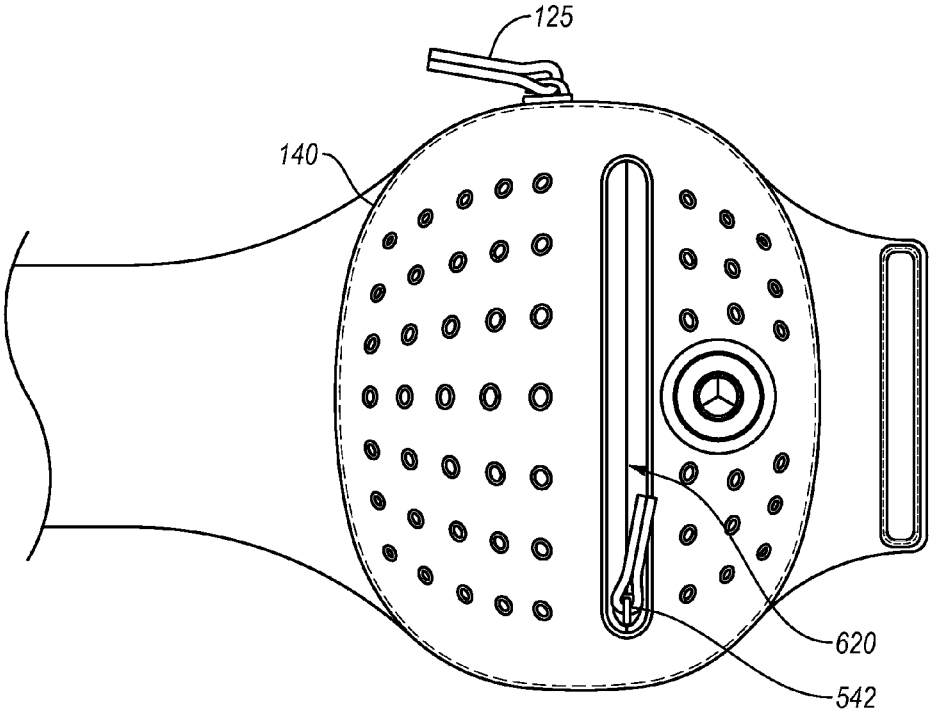
FIG. 10 illustrates an embodiment of a bicep hydration sleeve.

In one embodiment, the housing or fluid container can include one or more external pockets 620 (FIGS. 6A-6B). The housing 107 or container 202 can include one or more external pockets 620 having a closure member 624. In one aspect, hydration sleeve 100 can include external pockets 620 having a zipper 125 (FIG. 10). In one aspect, the housing 107 or fluid container 202 can include one or more external mesh pockets 620*a* (FIGS. 8-9), which may optionally include a welded mesh opening 122*a*. (FIG. 1A). The one or more external pockets 120 can include a pocket gusset 628 (FIG. 6A). In one aspect, the one or more external pockets 120*a* can include a magnet 126. (FIG. 8). In one example, the external pocket 620 can be on a bottom portion of the housing 107 or body 108 when the hydration sleeve 100 is attached to bicep region, wherein weight of objects in the pocket 620 can orient the mouthpiece upwards. The pocket 620 can be dimensioned to receive a music player, such as a smart phone having music, and the pocket can include an aperture adapted to allow for headphone cable to pass therethrough.

In one embodiment, the hydration sleeve 100 can include a strap coupling system that couples the fluid container 202 or housing 107 with the one or more straps 112, where the strap coupling system is decouplable therefrom. The strap coupling system can be configured as a quick-release coupling system that couples the fluid container 202 or housing 107 with the one or more straps 112, which coupling system is decouplable by snapping the container 202 or housing 107 from the one or more straps 112. The strap coupling system can include a coupling system having a male component and a female component that couples the fluid container 202 or housing 107 with the one or more straps 112 by coupling the container 202 or housing 107 to the one or more straps 112, which coupling system is decouplable by disengaging the male component with the female component. The strap coupling system can include a snap lock coupling system having a snap male component and a snap female component that couples the fluid container 202 or housing 107 with the one or more straps 112 by snapping the container 202 or housing 107 to the one or more straps 112, which coupling system is decouplable by disengaging the snap male component with the snap female component.

Figure 13:
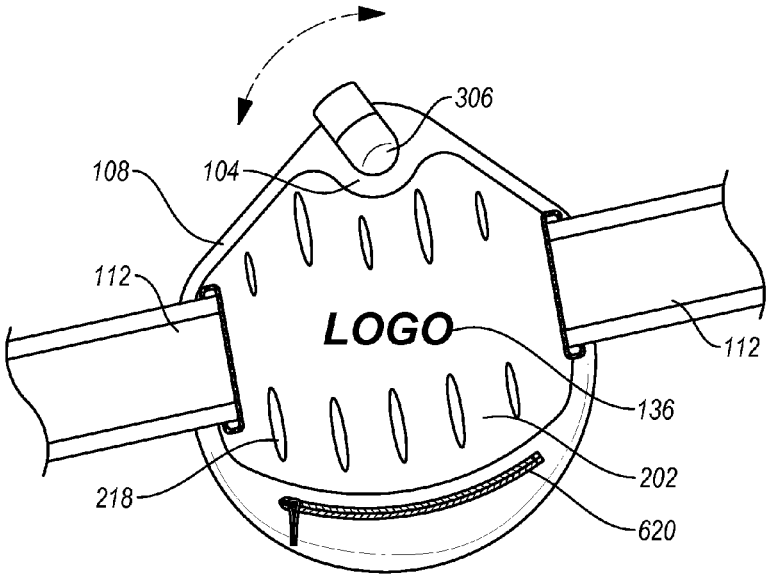
FIG. 13 illustrates an embodiment of a bicep hydration sleeve.
Figure 14:
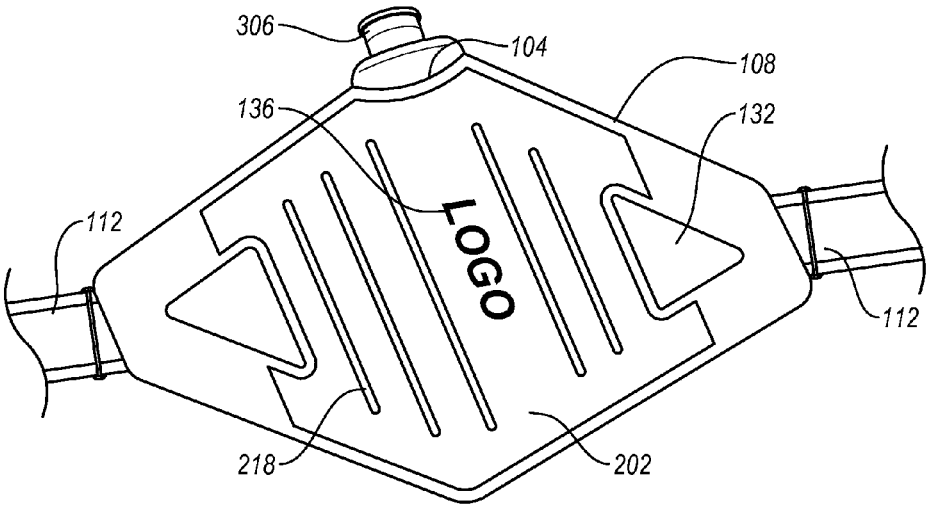
FIG. 14 illustrates an embodiment of a bicep hydration sleeve.
Figure 15:
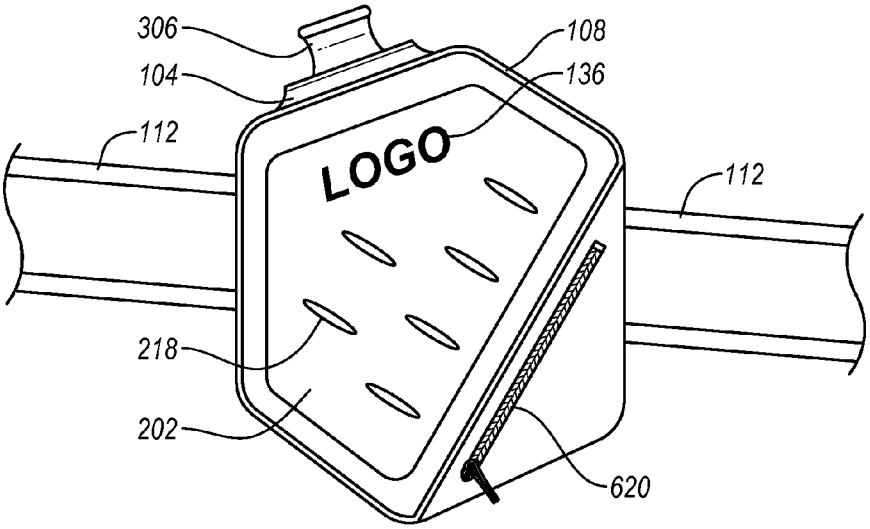
FIG. 15 illustrates an embodiment of a bicep hydration sleeve.
Figure 16:
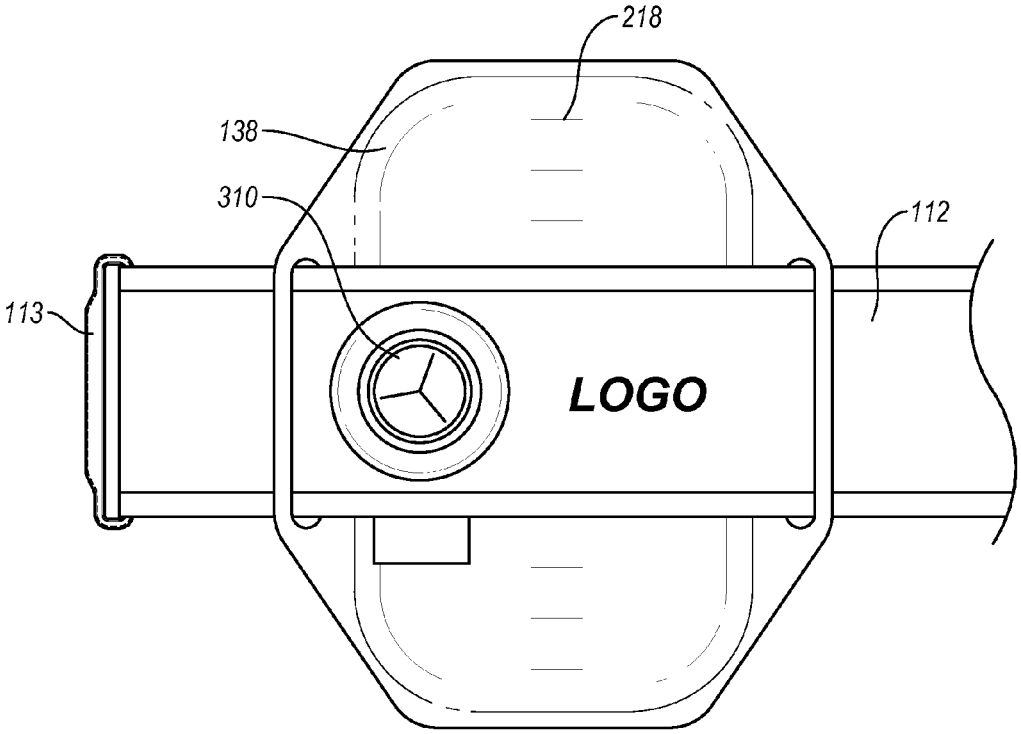
FIG. 16 illustrates an embodiment of a bicep hydration sleeve.
Figure 17:
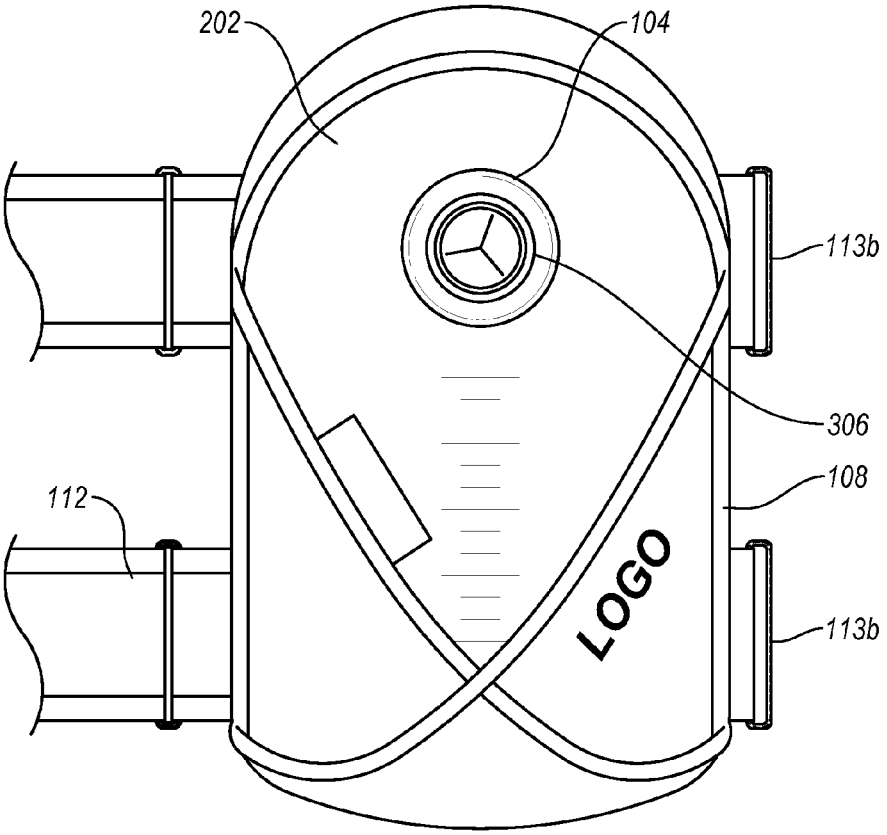
FIG. 17 illustrates an embodiment of a bicep hydration sleeve.
Figure 18:
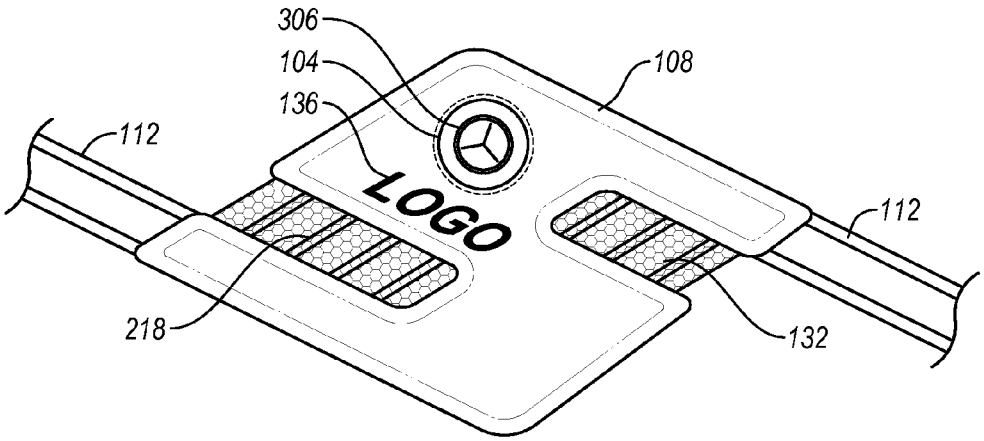
FIG. 18 illustrates an embodiment of a bicep hydration sleeve.

The hydration sleeve 100 can include various features as described herein and illustrated in the different figures. For example, the body 108 and/or fluid container 202 can include one or more ventilation apertures 132 (FIGS. 14 and 18). In another example, the body 108 and/or straps 112 can include one or more ventilation perforations 134. The ventilation perforations 134 can be arranged in a pattern or random. In another example, the hydration sleeve 100 can include indicia 136, such as a logo or trademark (FIGS. 13-15). In another example, the hydration sleeve can include a liquid container 202 or body 108 that has a translucent pouch 138, which can be viewable during use so that the user can see the amount of fluid contained therein (FIGS. 8-9 and 16). In one example, the hydration sleeve 100 can include a body 108 that has a window (not shown) through which the fluid container 202 is viewable. The fluid container 202 may also be translucent when contained within the internal chamber 510. In an example, the fluid container 202 can include one or more internal baffles 218 (FIGS. 8-9), which may be lines that are straight or curved, and can even be formed as indicia. In another example, the mouthpiece 306 can include a slit valve 310 (FIGS. 8-19). In one aspect, the hydration sleeve 100 can include one or more lights that are each configured to be selectively turned on or off with a constant or blinking beam of light, which can be LED, bulb, halogen, or other light emitter. In one aspect, the hydration sleeve 100 can include one or more light reflectors, which for example, the piping can be reflective or reflective patches can on the front wall 115.

Figure 11:
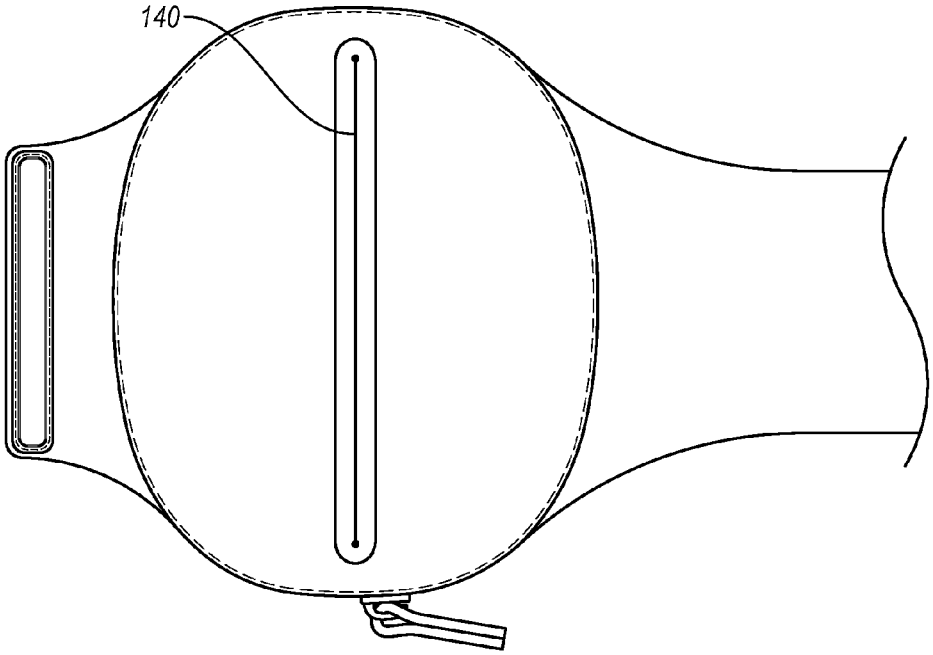
FIG. 11 illustrates an embodiment of a bicep hydration sleeve.

In one embodiment, the back wall 117 can define a chamber opening 140 as shown in FIG. 11. For example, the back wall 117 that defines the chamber opening 140 can include a slit, which opening 140 is configured as a slit. The slit opening 140 can be reinforced with one or more layers of additional material and/or stitching. In one aspect, the slit opening 140 can be along or orthogonal to a circumferential center axis 119 of the back wall 117 or any angle therebetween. In one aspect, the slit opening 140 can be configured as an open slit that is without a closure element such that when placed against the bicep region, the bicep presses against the back wall 117 and holds the slit opening 140 closed from opposite pressure from the fluid container 102.

The hydration sleeve 100 can be drunk from by moving the bicep to the chin so that the mouthpiece extends into the mouth of the user. The mouthpiece 306 can be rotated so that it points into the mouth of the user when the bicep touches or nearly touches the chin. The mouthpiece 306 can be frictionally engaged or otherwise coupled so that it does not freely rotate without force, which prevents the mouthpiece 306 to move into the wrong orientation during use or exercise. Friction coupling can be sufficient keep the mouthpiece 306 in a specific orientation with respect to the body 108, housing 107, and/or fluid container 202 so that it does not move under gravity or light force, but can be forcefully rotated to set the position. Accordingly, the hydration sleeve can be configured to be worn on the bicep region of either arm of the human with the mouthpiece 306 being more medial to a central circumferential axis than a lateral position. The mouthpiece 306 can be circumferentially symmetrical. When worn on the bicep region of either arm of the human, the mouthpiece 306 can be located proximal or closer to an inner arm region such as medial (or closer to the chest) and distal or further to an outer arm region such as lateral.

FIGS. 2A-2D show the flexible fluid bladder 202 can have a body 201 that includes the opening 204 being on circumferential center axis 219 of the bladder body 201 between a center point and a perimeter edge 216. The bladder opening 202 can have an annular member 206 configured to rotatably couple with the mouthpiece 306. The annular member 206 can be more rigid than the bladder body 201. The flexible fluid bladder 202 can have one or more expansion wings 241. Each expansion wing 241 can have a first gusset 242 and opposite second gusset 242. An elongate resealable opening 250 can extend from about a gusset 242 of one expansion wing 241 to about a gusset 242 of an opposite expansion wing 241.

The fluid container 202 can be a flexible bladder with various configurations. The fluid bladder 202 can be substantially flat when empty and having a low profile bulge when filled with fluid. As shown, the fluid container 202 can be configured as a bladder 202 with a welded perimeter 216. The fluid bladder 202 can be polymeric, elastomeric, or rubber bladder. The fluid bladder 202 can include a front wall 202*a* and a back wall 202*b* coupled together with the welded perimeter 216. The fluid container 202 can be removably couplable with a housing 107 (FIGS. 5A-5B), such as being removably received into the chamber 510 of the housing 107. Alternatively, the fluid container 202 can be is integrated with the housing 107 (FIGS. 8-9, 13-15, and 17-18). In one aspect, the fluid container 202 forms a body of the device (FIG. 16). In one aspect, the fluid container 202 has a diamond-like shape (FIGS. 13-15 and 18). In one aspect, the fluid container 202 is configured similarly to a camelback fluid container, but with a different size and shape FIG. 17).

The fluid bladder 202 cab includes a front wall 202*a*, a back wall 202*b* and one or more side walls 202*c*. The fluid bladder 202 can include expansion wings 241 that facilitate expansion when filled with fluid. The one or more expansion wings 241 can be on opposite sides, such as both being on the circumferential center axis 219 of the fluid bladder 202. The fluid bladder 202 can be symmetrical with respect to the opening 204 being on a circumferential center axis 219 of the fluid bladder 202. This configuration allows for the fluid bladder 202 to be substantially flat when empty and capable of being sucked dry so as to collapse when sucked dry. The expansion wings 241 can prevent fluid from sloshing within the fluid container 202. This can be achieved when there is little or no air in the fluid container 202, which is facilitated with the expansion wings 241. The fluid bladder 202 can have zero slosh tolerance so that weight of fluid does not shift during use or exercise or movement thereof.

In one embodiment, the fluid bladder 202 has a circumferential center axis 219 and a lateral central axis 223 that is normal to the circumferential center axis 219 such that these two axes form four quadrants on a front wall 202*a* of the fluid bladder 202. The opening 204 can be between the two quadrants on the front wall 202*a* along the circumferential center axis 219. In one aspect, the fluid bladder 202 has a circumferential center axis 219 and a lateral central axis 223 that is normal to the circumferential center axis 219 such that these two axes form a quadrant on a front wall 202*a* of the fluid bladder 202, the opening 204 being between two quadrants on the front wall 202*a* along the circumferential center axis 219 and not between the other two quadrants, that is, the opening 204 is not on the lateral central axis 223, but between the lateral central axis 223 and the perimeter 216. Accordingly, the opening 204 can be adjacent to a perimeter 216 or edge 245 of the fluid bladder 202 on a circumferential center axis 219.

In one embodiment, the fluid container 202 can includes one or more internal baffles 218 (see also FIGS. 8-9, and 13-15). The baffles 218 are shown as dashed lines in FIG. 2A to show they can be optional. The baffles 218 can function as slosh fins to prevent sloshing of the fluid. The one or more internal baffles 218 can extend from a front wall 202*a* to a back wall 202*b*. The internal baffles 218 can be arranged to inhibit fluid flow within the bladder 202. The baffles 218 can be one or more internal welds. The internal baffles 218 can be thin members or strips that are integrated with the front wall 202*a* and/or back wall 202*b*. When integrated with only one wall, the one or more internal baffles 218 can be free to move with respect to the front wall 202*a* or back wall 202*b*. The internal baffles can be in a fan shaped distribution. The internal baffles 218 configured as indicia (e.g. such as a logo, trademark or other numbers or letters). The internal baffles 218 can be configured as parallel lines. The internal baffles 218 can be in an alternating arrangement. The internal baffles 218 can be of different sizes or in a staggered arrangement. The internal baffles 218 can be configure as a first baffle system beginning at one end of the container and extending toward the other end and a second baffle system beginning at the other end and extending toward the one end.

In one embodiment, the opening 204 is more rigid than the bladder and protrudes from the bladder 202. The rigidness can be from a rigid annular member 206, such as a spout 314 (FIG. 3C). For example, the opening 204 can include the rigid annular member 206 that is threaded and protruding from the bladder 202, and wherein the mouthpiece 306 is cooperatively threaded with the rigid annular member 206.

In one embodiment, the fluid bladder 202 can be is substantially oval in shape. When the fluid bladder 202 is substantially oval in shape, it can include the circumferential center axis 219 being across the short side of the oval.

While the fluid container 202 of FIGS. 2A-2D illustrates a front wall 202*a* with the opening 204, it can be in a side wall 202*c* or weld seam 216. Also, the opening 204 can be oriented to point outward from the container 202. The opening 204 of the fluid container 202 can be configured so as to be aligned with a mouthpiece aperture 104 in the housing 107. The opening 204 can be arranged to point towards a mouth of the subject when worn on the bicep region. The opening 204 or rigid annular member 206 can include a straw (not shown) that extends into the fluid container. The opening 204 can be adapted to removably receive the mouthpiece 306. As such, the opening 204 and mouthpiece 306 can have a cooperative sliding engagement, a cooperative threaded engagement, snap fit, friction fit, or the like.

While the fluid container 202 can have various volumes, it has been found that large volumes can add to much weight to the bicep. The added weight can cause skeletal problems when not balanced. As such, the fluid container 202 can be significantly smaller than many commercial hydration systems. The fluid container can have a maximum fluid volume of about 12 oz, preferably from about 3 oz to about 10 oz, more preferably about 4 oz to about 8 oz, and most preferably about 6 oz. It has been found that 6 oz of fluid can be sufficient for must exercise routines, such as for running about 30 minutes. When a kit of two hydration sleeves is used, twice the hydration potential can be worn on the bicep region.

Figure 2D:
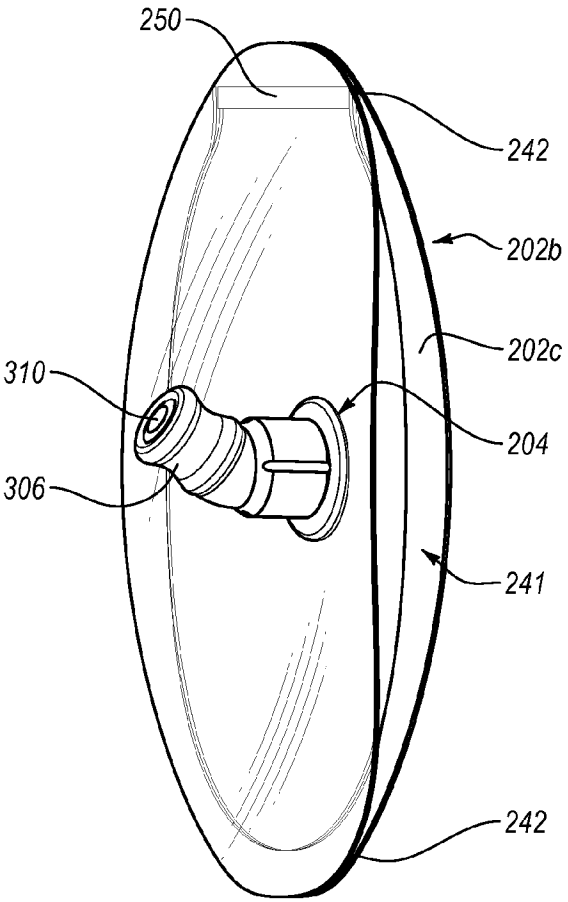
Figure 2C:
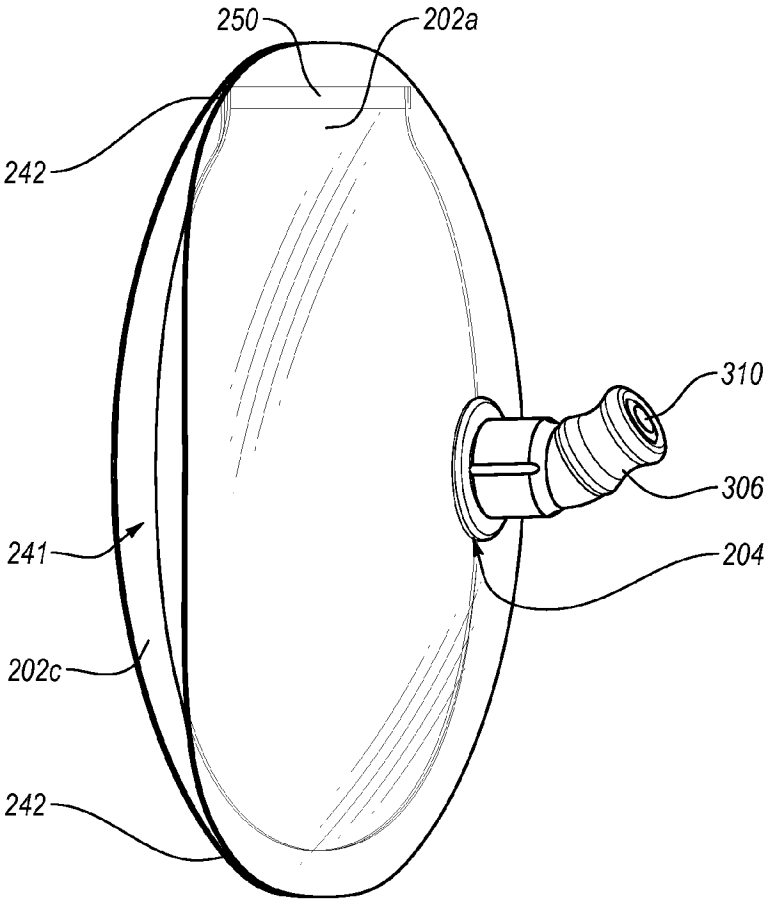

The fluid container 202 in the form of the bladder can be configured to be reusable, and can easily be refillable as well as washable. The fluid container 202 (e.g., bladder 202) can include a resealable elongate opening 250 as shown in FIGS. 2B-2C. The resealable elongate opening 250 can extend across a portion or all the way across the bladder 202 so as to bisect the bladder. The resealable elongate opening 250 can be on a side different from the opening 202. The resealable elongate opening 250 can be on an upper-most side when the hydration sleeve 100 is worn, and thereby the bladder can be left bicep specific or right bicep specific. That is, when worn, the resealable elongate opening 250 always opens upward, not downward. The resealable elongate opening 250 can extend from one bladder wing 241 to another bladder wing 240, which can be from the crease or gusset of the bladder wings 241. The resealable elongate opening 250 can be considered to be a fluid tight opening 250. In order to access an internal surface, the bladder 202 can include a fluid tight opening 250 that is slit-shaped. The fluid tight opening 250 can be different or in addition to the main opening 204. The fluid tight opening can include seal, such as a fluid-tight zipper or zip-lock-like mechanism. For example, the fluid-tight opening can include a zipper, slide seal, or zip-lock in a crease between two bladder wings or surfaces.

FIGS. 3A-3D illustrate the mouthpiece 306, which can include a shell 311 defining an internal conduit 312 and having a first portion at angle from a second portion at from about 110 degrees to about 160 degrees. The first portion can be configured to rotatably couple with a spout 314 configured as the annular member 314 and the second portion being configured as a bite valve 310. The spout annular member 314, which can be used for annular member 206, can be located at a bottom opening of the first portion. A bite valve stem 318 can be located in the internal conduit 312 at the second portion.

The various figures illustrate embodiments of the mouthpiece 306 extending from the fluid container 202, through the opening 104 in the housing 107 so as to be capable of being drank from by a user. FIGS. 2B-2D specifically show the mouthpiece 306 coupled to the bladder 202. FIGS. 3A-3D illustrate the mouthpiece 306 and the components thereof that form the valve 310. The components include the shell 311 having an internal cavity 312 containing a spout 314 at the base 316, and a stem 318 at a tip 320. As shown in FIG. 3B, the internal cavity 312 can be shaped to receive the spout 314 and stem 318 so as to function as a bite valve 310. The mouthpiece 306 can have an angle from the base 316 to tip 320 that can allow for easier drinking during use, which angle can be greater than 90 degrees, such as from 110 degrees to about 160 degrees, from about 120 degrees to about 150 degrees, from about 130 degrees to about 140 degrees, or about 135 degrees. The angle is measured to be an obtuse angle from one end to the other. However, the angle can be considered to have a small angle when measured off of the central axis, such as by being from 5 degrees to about 90 degrees, 10 degrees to about 80 degrees, 15 degrees to about 70 degrees, 20 degrees to about 60 degrees, 30 degrees to about 50 degrees, or about 45 degrees. One example is 15 degrees. It should be understood that the angles described all form an open or obtuse angle from the base 316 to the tip 320 as shown.

FIG. 3C shows the spout 314 having a base 330 opposite of a tip 332 with an annular protrusion 334 and annular recess 336, which correspond with shapes within the internal cavity 312. An internal lumen (not shown) can fluidly couple the base 330 with the tip 332 so that liquid can pass therethrough. The base 330 can be adapted to be received into the opening 204 of the bladder 202. In one embodiment, the base 330 can be integrated with the bladder 202, and the shell 311 can be removably couplable with the spout 314. Basically, the spout 314 can function as a spout.

Figure 3D:
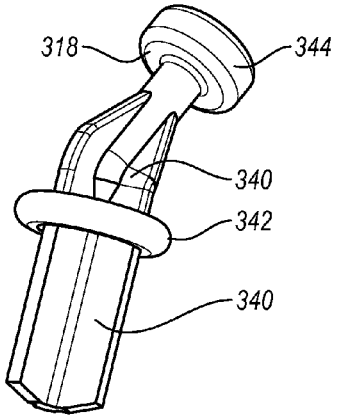

FIG. 3D shows the stem 318, which has longitudinal recesses 340 and an annular protrusion 342 that cooperate to provide the bite-valve functionality. When not being bit, the tip 344 can seal against the internal conduit 312 of the shell 311.

The spout 314 and shell 311 can include cooperative configurations for one to be received with the other, such as cooperative threading, a snap-lock fastening system, or the like. The spout 313 and shell 311 have an articulable configuration that allows for rotation.

In one embodiment, the opening 204 of the bladder 202 and mouthpiece 306 can have various coupling configurations. In one example, the opening 204 and mouthpiece 306 can be fixed such as to be adhered or otherwise immovable. In one example, the opening 204 and mouthpiece 306 can have an extendable configuration, where the mouthpiece 306 can be popped into and popped out from the opening 204. In one example, the mouthpiece 306 is screwed into the opening 204.

In one embodiment, the mouthpiece 306 can includes a slit valve, pop-top valve, soft-bite valve, mouthpiece, or the like. The mouthpiece 306 can include an articulating shell 310 that can be articulated. In one aspect, the valve of the mouthpiece 306 can be configured to open when bitten and closed when not infringed. In one aspect, the mouthpiece can include a low-profile configuration with a valve that pops out. The valve can be configured as a one-way valve so fluids only pass in a single direction. Alternatively, the valve can be two-way, which allows filling through the valve.

In one embodiment, the mouthpiece 306 can be bendable. In one option, when bent, the mouthpiece 306 can stay at the bent angle. This can include the mouthpiece 306 being capable of being bent to about 30 degrees to about 45 degrees from normal with respect to a front wall 202*a* of the bladder 202.

In one embodiment, the hydration sleeve 100 can include: a fluid container 202 with an opening 204; a mouthpiece 306 removably coupled with the opening 204 of the fluid container 202, the mouthpiece 306 having a valve member 310; a body 108 defining an internal chamber 510 dimensioned so as to receive the fluid container 202 therein with the mouthpiece 306 exposed through a mouthpiece aperture 104 in the body 108; one or more straps 112 coupled or integrated with the body 108, each strap 112 or combination of straps 112*a*,112*b* being dimensioned to fit around a bicep region of an arm of a human; and a fastener system 113 associated with the body 108 and/or straps 112 such that engagement of the fastener system 113 permits the hydration sleeve 100 to be worn on the bicep region, and disengagement of the fastener system 113 permits the hydration sleeve to be removed from the bicep region.

In one embodiment, the hydration sleeve 100 can include: a flexible fluid bladder 202 with a substantially rigid opening 204 having a rigid annular member 206 about the opening 204, the fluid bladder 202 being substantially flat when empty and having a low profile bulge when filled with fluid; a rotatable mouthpiece 306 removably coupled directly with the opening 204 by engaging the rigid annular member 206 of the fluid bladder 202, the mouthpiece 306 having a bite valve member 310; a flexible body 108 having a flexible housing 107 that defines an internal chamber 510, the housing 107 having a front wall 115 and a rear wall 117 opposite of the front wall 115, the front wall 115 and rear wall 117 are cooperatively dimensioned and shaped to fit on a bicep region of an arm of a human, where the front wall 115 and rear wall 117 defines an internal chamber 510 and chamber opening 540 dimensioned so as facilitate the fluid bladder 102, either empty or full of fluid, being removably received through the chamber opening 540 and into the internal chamber 510 and withdrawn therefrom, and the front wall 117 defining an opening 104 that corresponds with the opening 204 on a circumferential center axis 119 of the fluid bladder 102 with the opening 104 being dimensioned to removably receive the mouthpiece 306 such that the mouthpiece 306 is exposed from the housing 107 by extending through the opening 104 when the mouth piece 306 is coupled with the opening 204 of the fluid bladder 202, wherein the flexible body 108 is ambidextrous and configured to fit on a bicep region of either the right arm or left arm of the human with the opening 104 and mouthpiece 306 being on the circumferential center axis 219 of the bladder 202 and body 108; one or more straps 112 coupled or integrated with the body 108 or the housing 107, each strap 112 or combination of straps 112*a*,112*b* extending along the circumferential center axis 119 of the body 106 in one or both circumferential directions 121, and the one or more straps 112 cooperatively being dimensioned to fit around so as to circumnavigate the bicep region of the arm of the human; and a D-ring member 113*b* and VELCRO (e.g., hook and loop fastener) member 113*a* of fastener system 113 associated with the body 108 and/or straps 112 such that engagement of the fastener system 113 permits the hydration sleeve to be worn on the bicep region of the arm of the human, and disengagement of the fastener system 113 permits the hydration sleeve 100 to be removed from the bicep region of the arm of the subject.

In one embodiment, a hydration sleeve 100 (e.g., shown in FIGS. 8-9, 13-16, and 18) can include: a fluid container 202 shaped to conform with an arm of a human and having an opening 204; a mouthpiece 306 removably coupled with the opening 204 of the fluid container 202, the mouthpiece 306 having a valve member 310; one or more straps 112 coupled or integrated with the fluid container 202, each strap 112 or combination of straps 112 being dimensioned to fit around a bicep region of an arm of a human; and a fastener system 113 associated with the fluid container 102 and/or straps such that engagement of the fastener system 113 permits the hydration sleeve to be worn on the bicep region, and disengagement of the fastener system 113 permits the hydration sleeve to be removed from the bicep region.

In one embodiment, a hydration sleeve 100 can include: a flexible fluid bladder 102 with a substantially rigid opening 204, the fluid bladder 202 including a front wall 202*a* perimeterally sealed with a perimeter seal 216 with a back wall 202*b* such that the bladder 202 is substantially flat when empty and having a low profile bulge from the perimeter seal when filled with fluid; a mouthpiece 306 removably coupled directly with the opening 204 of the fluid bladder 202, the mouthpiece 306 having a bite valve member 310; a flexible housing 107 having a body 108 with a front wall 115 and a rear wall 117 opposite of the front wall 115, the front wall 115 and rear wall 117 being cooperatively dimensioned and shaped to fit on a bicep region of an arm of a human and dimensioned to define an internal chamber 510, and a wall 119 that defines a chamber opening 540 dimensioned so as facilitate the fluid bladder 102, either empty or full, being removably received through the chamber opening 540 and into the chamber 510 and withdrawn therefrom, and the front wall 115 defining an aperture 104 on a circumferential center axis 119 or plane that bisects the body 108, the aperture 104 being located between a lateral axis 123 and perimeter 111 of the body 108, the aperture 104 being dimensioned to removably receive the mouthpiece 306 such that the mouthpiece 306 is exposed from the housing 107 by extending through the aperture 104 when coupled with the opening 204 of the fluid bladder 202, wherein the flexible housing 107 is ambidextrous and configured to fit on a bicep region of a right arm or left arm of the human with the aperture 204 and mouthpiece 306 being on the circumferential center axis 119 or plane of the body 108; a long strap 112*a* and short strap 112*b* are coupled or integrated with the body 108 or the housing 1087, each strap 112*a*,112*b* extending along the circumferential center axis 119 or plane of the body 108 in opposite circumferential directions 121 and the long strap 112*a* and short strap 112*b* cooperatively being dimensioned to fit around so as to circumnavigate the bicep region of the arm of the human; and a D-ring 113*b* coupled with the short strap 112*b* and VELCRO (e.g., hook and loop fastener) 113*a* coupled with the long strap 112*a* such that engagement of the D-ring 113*b* with the long strap 112*a* and VELCRO (e.g., hook and loop fastener) 113*a* with the long strap 112*a* form a fastener system 113 that permits the hydration sleeve 100 to be worn on the bicep region of the arm of the human, and disengagement of the fastener system 113 permits the hydration sleeve 100 to be removed from the bicep region of the arm of the subject.

In one embodiment, the fluid container 102 and/or housing 107 can be rigid, and formed from a hard plastic. The straps can be flexible and coupled with the fluid container 102 or housing 107 as illustrated.

When the fluid container 102 and housing 107 are flexible, the one or more straps 112 can be integrated therewith. This can include the straps 112 being integrated with the housing 107. (FIG. 1A). In one aspect, the one or more straps are integrated with the container. (FIGS. 8-9). When the fluid container 102 and housing are rigid or flexible, the one or more straps 112 can be coupled thereto. As such, the straps 112 can be coupled to the housing (FIGS. 13-15 and 17-18) or coupled to the fluid container 102 (FIG. 16). In one aspect, the two straps 112*a*, 112*b* extend from opposite ends of the housing 107 or fluid container 102. In one aspect, two straps 112 can extend from the same side of the fluid container 102 (FIG. 17), with optional two corresponding straps on the other side or corresponding fasteners (e.g., D-rings) on the other side. In one aspect, one strap 112*a* is long and attached to one side of the housing 107 or fluid container 102 and the other strap 112*b* is short and attached to other side of the housing 107 or container 102. (FIG. 1A). In one aspect, the one or more straps 112 can be couplable and removable with respect to the housing 107 (FIGS. 13 and 15) or container 102 (FIG. 16). As such, the housing 107 or container 102 can include strap slits that receive the straps therethrough. When the straps 112 are couplable, a single strap can be used, which strap includes the fastener system components on opposite ends.

In one embodiment, the present invention includes a hydration sleeve kit that includes the hydration sleeve body 108 separate from one or more bladders 202. That is, multiple bladders 202 can be included for one sleeve body 108. For example, two bladders 202 can be included so that one can be cleaned while the other is in use. In another example, the kit can include two or more mouthpieces 306. The two or more bladders 202 can include a right bicep specific bladder and a left bicep specific bladder. Also, a kit may only include a single bladder, which may be either right bicep specific or left bicep specific, where the resealable opening 250 always opens upwards to define the specific bicep with the opening 204 pointing away from the bicep or away from the back wall 117.

Figure 12:
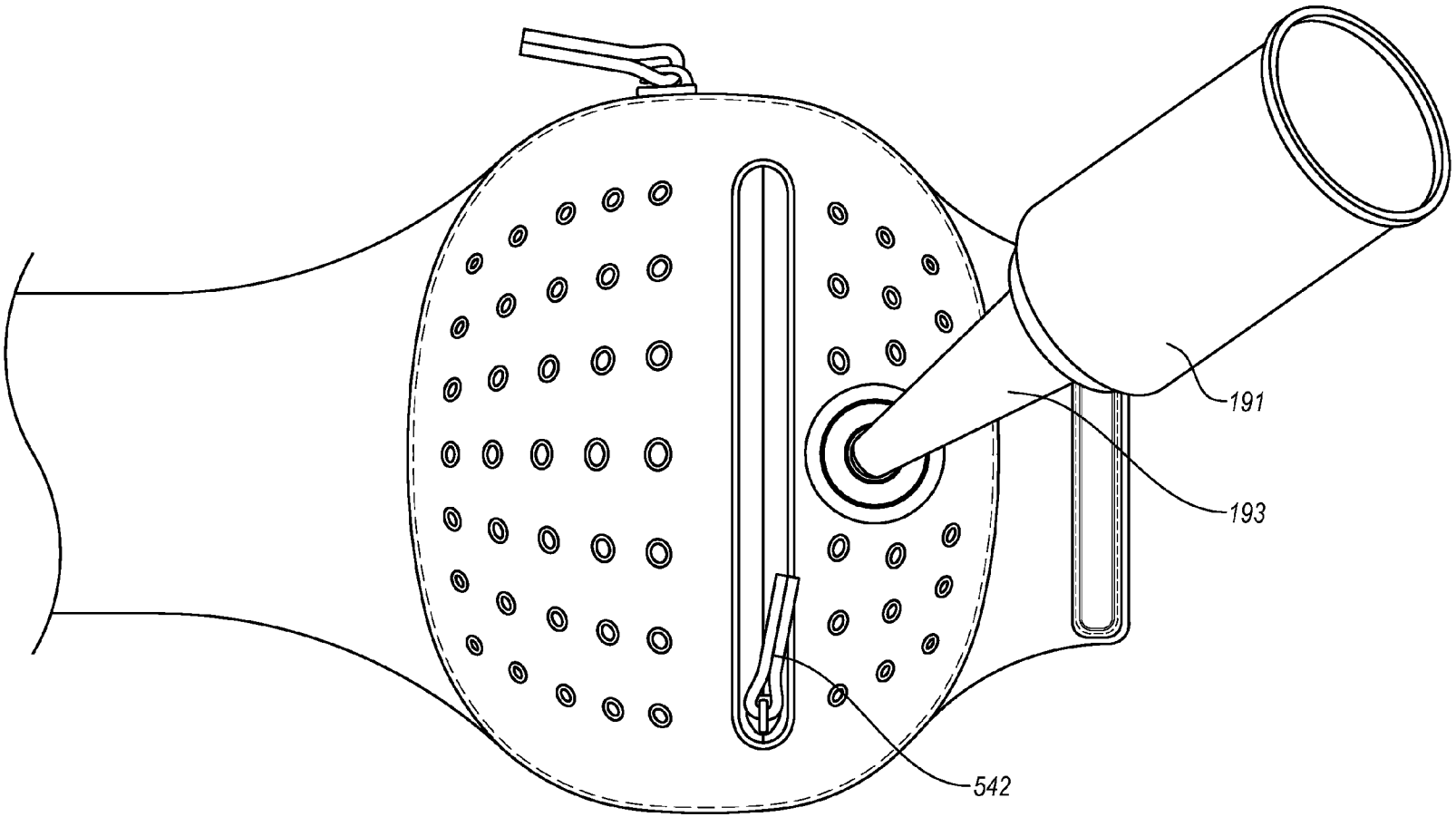
FIG. 12 illustrates an embodiment of a bicep hydration sleeve receiving a refill bottle.

In one embodiment, the kit can include a refill bottle 191 as shown in FIG. 12. The refill bottle can have a tip 193 that is dimensioned to be received through the opening 204 of the bladder or through the opening of the spout 314. The refill bottle 191 can have any size or dimension and can be refillable or prefilled with an electrolyte solution. The refill bottle 191 can be used by inserting the tip 193 into the bladder 202, and injecting liquid such as water or electrolyte solution into the bladder. This refill protocol can be performed with the hydration sleeve 101 worn or off the bicep, while resting or while exercising such as running. A special mouthpiece, such as a two-way valve or slit valve can be used for on the fly refilling. As such, the mouthpiece 306 can be cooperatively configured to receive the tip 193 of the refill bottle 191.

In one embodiment, the kit can include a disposable bladder kit 400 having a disposable bladder 410 as shown in FIG. 4A. The disposable bladder kit can also include reusable mouthpiece 412 as shown in FIG. 4B. The disposable bladder 410 can include a neck 414 that is adapted to receive the reusable mouthpiece 412. As such, the disposable bladder 410 can include the neck 414 being sealed with a seal member 415, and the reusable mouthpiece 412 can be inserted into the neck 414 so as to puncture the seal member 415. Accordingly, the reusable mouthpiece 412 can include an inner puncture member 416 that can puncture the neck 414 and an outer seal member 418. The disposable bladder kit 400 can be used by taking the disposable bladder 410, inserting the inner puncture member 416 into the neck 414 to puncture the seal member 415 and allow fluid to flow therefrom. Then the outer seal member 418 can be placed around the puncture member 416 and neck so as to provide a seal. The reusable mouthpiece 412 can be a bite valve that is sealed until bitten. Alternatively, the reusable mouthpiece 412 can be mounted onto the neck 414 with the inner puncture member 416 and outer seal member 418 together. The mouthpiece 412 can be configured to puncture a one-time use bladder 410 and seal around the puncture to enable a fluid conduit through the mouthpiece 412.

The mounting of the reusable mouthpiece 412 can be performed with the bladder 202 within or outside of the housing 107, while worn on unworn. The disposable bladder 410 can be prefilled with a liquid such as water or electrolyte solution.

In one embodiment, the kit can include: the hydration sleeve body 108 having the housing 107 and straps 112; the bladder 202; and the mouthpiece 106, each of which are unassembled. In one aspect, the kit can include a carrying case configured to carry the hydration sleeve body, bladder(s), and mouthpiece(s).

In one embodiment, the kit can include a drying rack adapted to be used to dry the bladder. The drying rack can be configured to be received into the bladder 202, either through bladder 202 opening 204 or through the resealable opening 250. The drying rack can be dimensioned and configured to hold the bladder 202 vertical with the resealable opening pointing down so that any residual water can flow out the resealable opening 250. In one example, the drying rack can have a body that is adapted to be fit into the resealable opening and extend to the opposite wall of the internal chamber. The body can have three or more legs so as to form at least a tripod. The legs can be movable attached to the body so that the legs can be opened to at least a tripod so that the drying rack can stand with balance to hold the bladder 202 open. The legs can be closed for a smaller dimension for portability. The legs can be selectively opened and closed. The legs and body can include members that can be shaped as desired, such as by having wires or other malleable and shape-forming and shape-holding members. For example, the legs can include thick wires that are bendable with enough strength to retain the shape and hold the bladder, and may include an elastomeric or other polymeric coating to protect the bladder. Thus, the drying rack can have a narrow conformation when the legs are closed and an expanded (e.g., like a tripod) confirmation when the legs are opened. Of course, the drying rack could include four or more legs.

In one embodiment, the present invention includes a method of manufacturing the hydration device. Such a method can include: making the fluid container; making the hydration sleeve body to include the housing and one or more straps; and attaching the fastener system to the body. In one aspect, the method can include: making the container; making the housing; attaching the straps to the housing; and attaching the fastener system to the container and/or body. In one aspect, the method can include: making the container; attaching the straps to the container; and attaching the fastener system to the container. In one aspect, the method can include attaching the mouthpiece to the container. In one embodiment, the method can include introducing fluid of from about 3 oz to about 12 oz, or about 4 oz to 10 oz, or about 6 oz into the container.

In one embodiment, the present invention includes a method of hydrating a human. Such as method can include: providing the hydration sleeve of any one of the embodiments described herein; and attaching the hydration sleeve to the bicep region of the arm of the human user (FIG. 7A). The human user can drink from the mouthpiece of the hydration device without using their hands (FIG. 7B). The human user can also drink while participating in an athletic activity, such as walking, jobbing, running, biking, weight lifting, and the like. In one features, since hands are not needed for drinking from the mouthpiece, the user can have an object held in one or both of their hands. For example, during weight lifting, the user can hold weights in each hand, and drink from the mouthpiece. The user can simply move their bicep close to their mouth so that the mouthpiece protrudes into their mouth, and then can drink with the bite and/or suck action. The method can include the human performing athletic activities while wearing the hydration sleeve on the bicep and drinking therefrom.

The hydration method can include: providing the hydration sleeve or kit thereof as described herein; and attaching the hydration sleeve to the bicep region of the arm of the human. The hydration method can further include bending and raising the elbow of the arm having the hydration sleeve thereon so that the mouthpiece reaches the mouth of the human, and operating the mouthpiece with the human's mouth so as to obtain a fluid from the container. The hydration method can also include drinking from the mouthpiece without use of either hand of the human during the drinking protocol. Once the hydration sleeve is mounted on the bicep, the drinking protocol can be implemented without using hands.

The hydration method can include attaching the hydration sleeve to the bicep region of one arm with only the hand of the other arm. This can be part of the mounting protocol. The mounting protocol can include passing the long strap through the D-ring and fixing the VELCRO (e.g., hook and loop fastener). More generally, the straps and fasteners can be manipulated to secure the hydration sleeve to the bicep region. The mounting protocol can include attaching the hydration sleeve to the bicep region such that the mouthpiece is more medial than lateral. That is, the mouthpiece is pointing inward instead of outward, where the inward direction points the mouthpiece toward the mouth when the elbow is raised to the chin. Also, the mounting protocol can include attaching the hydration sleeve to the bicep with the mouthpiece pointing towards the human's mouth. The method can also include mounting the hydration sleeve to each bicep of the human.

In one embodiment, the hydration method can include a sleeve preparatory protocol. The sleeve preparatory protocol can include inserting the bladder into the chamber of the housing. The sleeve preparatory protocol can include filling the bladder with water or electrolyte solution. The sleeve preparatory protocol can include coupling the mouthpiece to the bladder after it is inserted into the chamber of the housing, where the mouthpiece is inserted through an aperture of the housing and coupled with the opening of the bladder. The sleeve preparatory protocol can include mounting the mouthpiece to the bladder before the bladder is inserted into the chamber of the housing.

In one embodiment, the hydration method can include a cleaning protocol for cleaning the bladder. The cleaning protocol can include opening the bladder, inserting a cleaning solution into the bladder, inserting a cleaning instrument into the bladder, cleaning the bladder with the cleaning solution and cleaning instrument, washing the cleaning solution from the bladder, and closing the bladder. The cleaning protocol can include unsealing the resealable elongate opening, and cleaning therethrough. As such, the cleaning protocol can omit cleaning through the opening that receives the mouthpiece. The cleaning protocol can also include leaving the bladder open to dry, which can include leaving the resealable elongate opening open. The method can include opening the bladder by opening includes a fluid-tight zipper, slide seal, or zip-lock in the bladder body or a bladder wing. The cleaning protocol can also include using the drying rack to dry the bladder. The drying rack can be inserted into the bladder so that the bladder is expanded and opened and having an opening pointing down so that residual water drains from the bladder. The drying rack can be inserted into the resealable opening such that legs of the drying rack extend from the resealable opening so that the drying rack can be balanced on the legs with the resealable opening pointing downwards.

In one embodiment, the hydration method can include: lifting the elbow of the arm having the hydration sleeve towards the human's mouth; placing the mouthpiece into the humans mouth; biting the mouthpiece; and sucking fluid from the bladder. The crease of the elbow can be touching or adjacent to the chin, where the crease of the elbow is the crease portion on the inner arm, which is considered to be having the elbow touching or adjacent to the chin. The raised elbow can held so that the users arm is substantially parallel with the ground. The hand or forearm can be bent or extended from the user's face. The elbow raise and drink can be performed in a stride, or held during multiple strides, when the exercise is running. Also, the elbow can be positioned as medial as possible during the drinking, or the elbow position can be adjusted as needed to facilitate drinking. The user can use the hand of the arm having the hydration sleeve to hold onto the opposite shoulder to maintain balance while drinking, which can be done during an exercise such as running. The hand on the other shoulder can be used to leverage the hydration sleeve on the bicep toward the mouth. Similarly, the hand can be placed on the opposite side of the neck for leverage and balance. The drinking can be performed with the neck held straight and not bent or turned. Alternatively, the neck can be turned toward the bicep and hydration sleeve if needed, and the neck can be bent downward to reach the mouthpiece. In one aspect, any one or all of the lifting, placing, biting, and sucking can be done: without use of the human's hand; or while exercising; or by only moving the arm having the bicep and the subject's mouth and/or neck.

In one embodiment, the hydration method can include: moving the hydration sleeve on the bicep towards the human's mouth by movement of the arm having the bicep; moving the human's mouth downward towards the hydration sleeve; placing the mouthpiece into the humans mouth; biting the mouthpiece; and sucking fluid from the bladder, wherein the lifting, placing, biting, and sucking are all done without use of the human's hand while resting or exercising.

In one embodiment, the hydration method can include: moving the hydration sleeve on the bicep towards the human's mouth by movement of the arm having the bicep without moving the human's mouth downward towards the hydration sleeve and/or without turning the humans' head; placing the mouthpiece into the humans mouth; biting the mouthpiece; and sucking fluid from the bladder, wherein the lifting, placing, biting, and sucking are all done without use of the human's hand and while exercising.

In one embodiment, the method can include: moving, flexing, bending, or otherwise setting the mouthpiece to be at an angle of up to about 30 or 40 degrees with respect to normal or 180 degrees from the opening of the bladder.

In one embodiment, the method can include: mounting the hydration sleeve on the bicep such that the bicep holds the chamber opening closed. When a zipper is included, the method can include zipping the zipper to enclose the bladder in the internal chamber.

In one embodiment, the method can include removing the hydration sleeve from the bicep; removing the bladder from the chamber via the chamber opening; refilling and/or cleaning the bladder; and inserting a second bladder into the chamber via the chamber opening. In one embodiment, the method can include mounting the hydration sleeve so that the mouthpiece is substantially midway between the elbow crease and armpit crease of the human; and/or mounting so that the hydration sleeve is oriented with the mouthpiece closest to the human's mouth.

In one embodiment, the method can include providing a refill bottle having a nozzle that is configured to be received into and through the mouthpiece so as to be capable of refilling the bladder through the mouthpiece; inserting the nozzle into the mouthpiece; and refilling the bladder while worn on the bicep. This can be while exercising or without stopping an exercise or on the fly. Depending on the size of the bladder, the refill method can include introducing fluid of from about 3 oz to about 12 oz or about 4 oz to about 10 oz or about 6 oz into the bladder through the nozzle using a refill bottle on the fly. Alternatively, the refill method can include opening the fluid-tight zipper, slide seal, or zip-lock in the bladder body or a bladder wing and introducing the fluid therethrough.

In one embodiment, the hydration method can be performed without sloshing water in the bladder. As such, the method can include removing gas from inside the container prior to use in an athletic activity. Also, the method can include drinking water from the container without introducing a void space therein.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims. All references recited herein are incorporated herein by specific reference in their entirety.

The invention claimed is:

1. A bicep hydration sleeve comprising:

a flexible fluid bladder having a bladder body defining an internal volume of less than or about 12 oz and having a top bladder wall with an opening therethrough into the internal volume and having a bottom bladder wall coupled to the top bladder wall;

an annular member mounted in the opening of the bladder, the annular member being more rigid than the bladder body and having an annular member aperture being in a plane with the top bladder wall;

a bite valve mouthpiece rotatably coupled with the annular member of the opening of the fluid bladder so as to be in fluid communication with the internal volume and protrude from the top bladder wall, the mouthpiece having an axis of rotation normal to the annular member aperture, the mouthpiece being frictionally engaged with the annular member and capable of being forcefully rotatable with respect to the annular member, the mouthpiece having a first portion mounted into the annular member and a second portion mounted to the first portion at an obtuse angle relative to the first portion, the obtuse angle being 110 degrees to 160 degrees, the second portion having a bite valve; and a flexible hydration sleeve body having a housing and one or more straps, the housing having an internal chamber dimensioned to retain the flexible fluid bladder with a chamber opening dimensioned to receive the flexible fluid bladder therethrough and having a mouthpiece aperture dimensioned to receive the mouthpiece coupled therethrough when the flexible fluid bladder having the mouthpiece is located in the internal chamber, the one or more straps dimensioned such that the hydration sleeve body fits around a bicep region of a human, the one or more straps having at least a first strap with a first fastener member of a fastening system with a second fastener member of the fastening system being on the housing or another strap opposite of the first strap, the second fastener member of the fastening system being capable of receiving the first strap with the first fastener member therethrough and the first fastener member being configured to be removably coupled with the first strap.

2. The hydration sleeve of claim 1, comprising an elongate resealable opening between the top bladder wall and bottom bladder wall.

3. The hydration sleeve of claim 2, wherein the mouthpiece is removably couplable with the annular member.

4. The hydration sleeve of claim 3, the base being integrated with the bladder.

5. The hydration sleeve of claim 4, comprising the mouthpiece having a shell that is removably couplable with the spout of the annular member.

6. The hydration sleeve of claim 5, comprising a stem in the shell, the stem having the obtuse angle.

7. The hydration sleeve of claim 6, comprising the mouthpiece and annular member having a snap-fit rotational coupling.

8. The hydration sleeve of claim 3, the annular member comprising a base and opposite tip with a spout therebetween that has annular protrusions and/or annular recesses.

9. The hydration sleeve of claim 8, the mouthpiece comprising an internal conduit with annular recesses that correspond with annular protrusions on the spout and/or annular protrusions that correspond with annular recesses on the spout.

10. The hydration sleeve of claim 3, the base being located in the opening of the bladder.

11. The bicep hydration sleeve of claim 1, the bite valve mouthpiece comprising:

a shell defining an internal conduit and having a first portion at an angle from the second portion that is between 110 degrees and 160 degrees, the first portion being configured to rotatably couple with the annular member and the second portion being configured as a bite valve;

the annular member located at a bottom opening of the first portion; and a bite valve stem located in the internal conduit at the second portion.

12. The bicep hydration sleeve of claim 11, the hydration sleeve body comprising:

a base sheet member that forms a wall of the housing and the one or more straps;

a top sheet member directly or indirectly coupled to the base sheet member so as to define the housing and internal chamber, the top sheet having the mouthpiece aperture; and the chamber opening being positioned between the base sheet member and top sheet member, the chamber opening having a closable mechanism.

13. The hydration sleeve of claim 12, comprising the housing having insulation in the internal chamber.

14. The hydration sleeve of claim 13, wherein the chamber opening allows the top sheet member to open away from the bottom sheet member in a openable orientation directed away from the mouthpiece aperture.

15. The bicep hydration sleeve of claim 11, the flexible fluid bladder comprising:

the opening being on a circumferential center axis of the bladder body between a center point and a perimeter edge;

the flexible fluid bladder having one or more expansion wings, each expansion wing having a first gusset and opposite second gusset; and an elongate resealable opening extending from about a gusset of one expansion wing to a gusset of an opposite expansion wing.

16. The hydration sleeve of claim 12, the housing comprising:

a pocket defined by the top sheet and an intermediate pocket sheet that is located between the top sheet and base sheet so that the pocket is adjacent to the top sheet and the internal chamber is adjacent to the base sheet, the pocket having a pocket opening; and a pocket fastener system at the pocket opening having a first pocket fastener member that fastens to a second pocket fastener member.

17. The hydration sleeve of claim 1, the hydration sleeve body comprising:

the first strap being elongate and having a plurality of vent apertures;

a second strap being shorter than the first strap, the second strap having the second fastener member;

the first fastener member including hook and loop fasteners;

the second fastener member including a D-ring.

18. The hydration sleeve of claim 1, comprising:

the flexible fluid bladder comprising:

the opening being on a circumferential center axis of the bladder body between a center point and a perimeter edge;

an elongate resealable opening between the top bladder wall and bottom bladder wall;

the mouthpiece comprising:

a shell defining an internal conduit and having a first portion at an angle from the second portion that is between 110 degrees and 160 degrees, the first portion being configured to rotatably couple with the annular member and the second portion being configured as a bite valve;

the annular member located at a bottom opening of the first portion; and a bite valve stem located in the internal conduit at the second portion;

the hydration sleeve body comprising:

a base sheet member that forms a wall of the housing and the one or more straps;

a top sheet member directly or indirectly coupled to the base sheet member so as to define the housing and internal chamber, the top sheet having the mouthpiece aperture; and the chamber opening being positioned between the base sheet member and top sheet member, the chamber opening having a closable mechanism;

the housing comprising:

a pocket defined by the top sheet and an intermediate pocket sheet that is located between the top sheet and base sheet so that the pocket is adjacent to the top sheet and the internal chamber is adjacent to the base sheet, the pocket having a pocket opening; and a pocket fastener system at the pocket opening having a first pocket fastener member that fastens to a second pocket fastener member;

the hydration sleeve body comprising:

the first strap being elongate and having a plurality of vent apertures;

a second strap being shorter than the first strap, the second strap having the second fastener member;

the first fastener member including hook and loop fasteners;

the second fastener member including a D-ring.

19. The hydration sleeve of claim 1, comprising the housing having insulation in the internal chamber.

* * * * *